US005671327A

United States Patent [19]

Akamine et al.

[11] Patent Number: 5,671,327

[45] Date of Patent: Sep. 23, 1997

[54] SPEECH ENCODING APPARATUS UTILIZING STORED CODE DATA

[75] Inventors: Masami Akamine, Yokosuka; Masahiro Oshikiri, Urayasu; Kimio Miseki, Kawasaki, all of Japan

[73] Assignee: Kabushiki Kaisha Toshiba, Kawasaki, Japan

[21] Appl. No.: 7,710

[22] Filed: Jan. 22, 1993

Related U.S. Application Data

[63] Continuation-in-part of Ser. No. 964,270, Oct. 21, 1992, abandoned.

[30] Foreign Application Priority Data

| | | | |
|---|---|---|---|
| Oct. 21, 1991 | [JP] | Japan | 3-272940 |
| Jan. 24, 1992 | [JP] | Japan | 4-011177 |
| Oct. 16, 1992 | [JP] | Japan | 4-278301 |

[51] Int. Cl.[6] ..... G10L 3/02; G10L 9/00

[52] U.S. Cl. ..... 395/2.28; 395/2.32; 395/2.29; 395/2.37

[58] Field of Search ..... 381/36–40, 48–51; 395/2, 2.1, 2.3, 2.31, 2.29, 2.67, 2.69, 2.28, 2.32, 2.37

[56] References Cited

U.S. PATENT DOCUMENTS

| | | | |
|---|---|---|---|
| 5,208,862 | 5/1993 | Ozawa | 381/36 |
| 5,230,036 | 7/1993 | Akamine et al. | 395/2 |
| 5,323,486 | 6/1994 | Taniguchi et al. | 395/2.31 |
| 5,327,521 | 7/1994 | Savic et al. | 395/2.81 |

*Primary Examiner*—Tariq R. Hafiz

*Attorney, Agent, or Firm*—Oblon, Spivak, McClelland, Maier & Neustadt, P.C.

[57] ABSTRACT

A learning-type speech encoding apparatus comprises an adaptive code book storing driving signal vectors, a minimum distortion searching circuit for searching the adaptive code book for an optimum driving signal vector on the basis of the input speech signal, a synthesizing filter for synthesizing a speech signal using the optimum driving signal vector retrieved, a buffer for storing the optimum driving signal vector retrieved, a training vector creating section for producing a training vector by segmenting the stored driving signal vector in units of a specified length, and a learning section for learning by constantly updating the driving signal vectors in the code book on the basis of the training vector.

17 Claims, 22 Drawing Sheets

SPEECH ENCODING APPARATUS UTILIZING STORED CODE DATA

CROSS-REFERENCES TO THE RELATED APPLICATIONS

This application is a continuation-in-part of U.S. patent application Ser. No. 07/964,270, filed on Oct. 21, 1992 abandoned.

BACKGROUND OF THE INVENTION

1. Field of the Invention

This invention relates to a speech encoding apparatus, and more particularly to a speech encoding apparatus suitable for encoding a speech signal at a low-bit rate less than approximately 8 kbps.

2. Description of the Related Art

Techniques for efficiently encoding a speech signal at a low bit rate are important for effective use of radio waves and the reduction of communication cost in mobile radio communication such as automobile telephone and in private telecommunication. The CELP (Code Excited Linear Prediction) system is a known speech encoding system that produces high-quality speech at a bit rate as low as less than 8 kbps.

The CELP system has been attracting attention because of its ability to synthesize high-quality speech and has undergone various improvements including the pursuit of higher speech quality and a reduction in the amount of calculations, since the system was disclosed in M. R. Schroeder and B. S. Atal at AT & T Bell Labs, "Code-Excited Linear Prediction (CELP) High-Quality Speech at Very Low Bit Rates," Proc. ICASSP, 1985, pp. 937–939 (literature 1). The CELP system is characterized by storing driving signals of an LPC (Linear Predictive Coding) synthesizing filter into a code book in the form of driving signal vectors and searching the code book for the optimum driving vector while evaluating the error between the synthetic speech signal and the input speech signal.

FIG. 22 is a block diagram of a speech encoding apparatus using the latest CELP system. In FIG. 22, the sampled speech signal train is supplied in frames to the input terminal 600. The frame is made up of L signal samples. When the sampling frequency is 8 kHz, L is generally set to L=160. Although not shown in FIG. 22, before the search for the driving signal vector, the input L samples of the speech signal train undergo LPC analysis to extract LPC prediction parameters $\{\alpha: i=1, 2, \ldots, p\}$ where p is the prediction order, normally set to p=10. The LPC prediction parameter $\alpha$ is supplied to an LPC synthesizing filter 630. The transfer function H(z) of the LPC synthesizing filter 630 is expressed by equation (1):

$$H(z) = \frac{1}{1 - \sum_{i=1}^{p} \alpha_i z^{-i}} \tag{1}$$

The process of searching for the optimum driving signal vector while synthesizing a speech signal will be explained. First, the effect of the internal state of the synthesizing filter 630 in the preceding frame on the current frame is subtracted from one frame of speech signal supplied to the input terminal 600 at a subtracter 610. The signal train obtained at the subtracter 610 is divided into four subframes, which become the target signal vectors for each subframe.

The driving signal vector to the LPC synthesizing filter 630 is obtained from an adder 660 that adds the driving signal vector selected from an adaptive code book 640 and multiplied by a specified gain at a multiplier 650 to the noise vector selected from a white noise code book 710 and multiplied by a specified gain at a multiplier 720.

The adaptive code book 640 performs pitch prediction analysis in a closed-loop action or analysis by synthesis, the details of which are disclosed in W. B. Kleijin, D. J. Krasinski and R. H. Ketchum, "Improved Speech Quality and Efficient Vector Quantization in CELP," Proc. ICASSP, 1988, pp. 155–158 (literature 2). According to literature 2, by causing a delay circuit 670 to delay the driving signal of the LPC synthesizing filter 630 by one sample over the pitch searching range from a to b (a and b indicate the sample numbers of the driving signal, normally set to a=20 and b=147), the driving signal vectors for the pitch periods of samples ranging from a to b are produced, and then stored as code-words in the adaptive code book.

In searching for the optimum driving signal vector, the code-word for the driving signal corresponding to each pitch period is read one by one from the adaptive code book 640, and then multiplied by a specified gain at the multiplier 650. Then, the LPC synthesizing filter 630 performs a filtering operation to produce a synthetic speech signal vector. This synthetic speech signal vector produced is subtracted from the target signal vector at a subtracter 620. The output of the subtracter 620 is supplied via an auditory weighting filter 680 to an error computing circuit 690, which calculates the mean square error. The information on the mean square error is supplied to a minimum distortion searching circuit 700, which detects the minimum of the error.

The above-described processes are carried out for the code-words of all driving signal vectors in the adaptive code book 640. The minimum distortion searching circuit 700 finds the number of a code-word that provides the minimum of the mean square error. The gain multiplied at the multiplier 650 is determined so that the mean square error may be minimal.

Next, the search for the optimum white noise vector is made in the same manner. Specifically, the code-word for each noise vector is read one by one from the white noise code book 710, and then multiplied by a specified gain at the multiplier 720. Then, the LPC synthesizing filter 630 performs a filtering operation to produce a synthetic speech signal vector. This synthetic speech signal vector produced is subtracted from the target signal vector at the subtracter 620. The output of the subtracter 620 is supplied via the auditory weighting filter 680 to the error computing circuit 690, which calculates the mean square error for each noise vector. The information on the mean square error is supplied to the minimum distortion searching circuit 700, which finds the number and gain of a noise vector that provides the minimum of the mean square error. The auditory weighting filter 680 shapes the spectrum of the error signal from the subtracter 620 to reduce the distortion perceptible to our ears.

In this way, because the CELP system obtains the optimum driving signal vector that minimizes the error between the synthetic speech signal and the input speech signal, it is possible to synthesize a high-quality speech even at a bit rate as low as about 8 kbps. At a bit rate lower than 8 kbps, however, degradation of speech quality is perceptible.

It is conceivable that the degradation of speech quality is attributable to the fact that the number of bits used to express the driving signal is small because of the lower bit rate. Specifically, the lower bit rate makes the length of the driving signal vector to be analyzed longer, which permits the feature of the input to change more easily in the analyzing section. As a result, the adaptive code book is less likely to express the input signal well, resulting in a reduction in the capability of the adaptive code book.

Because the number of bits used for the noise code book is smaller due to the lower bit rate, it takes more time for the adaptive code book to express the changed input signal well.

As noted above, in the conventional CELP system with the adaptive code book, the lower bit rate makes the length of the driving signal to be synthesized longer and the number of bits used for the noise code book smaller. Because of this, the capability of the adaptive code book is reduced, and it takes more time for the adaptive code book to express the changed input signal well.

In the conventional CELP system that can synthesize a high-quality speech at a bit rate of 8 kbps or more, there is the problem that at a bit rate lower than 8 kbps, the number of bits allocated to the encoding of the driving signal is so small that the quality of the synthesized speech is perceptibly degraded and is unacceptable for practical use.

Generally, in a speech encoding apparatus, the mapping Q from the total set X of vectors $x=(x_1, x_2, \ldots, x_K)$ belonging to the K-dimensional vector space to a set $Y=\{y_l; l=1, \ldots, L\}$ of L K-dimensional representative vectors $y_l=y_{11}, y_{12}, \ldots, y_{lK}$) can be expressed by the following equation (a).

$$Q:X \rightarrow Y \tag{a}$$

where it is supposed that the finite area division Si (i=1, . . . , L) of X satisfies the following equation (b).

$$\bigcup_{i=1}^{L} Si = X,\ Si \cap Sj = \Phi (i \neq j) \tag{b}$$

Therefore, the input vector x is mapped to y according to the mapping Q and is expressed by the following equation (c).

$$Q(X)=y_i \text{ if } X \in Si \tag{c}$$

An example of the concrete construction of the conventional speech encoding apparatus is shown in FIGS. 24 and 25. An encoding section shown in FIG. 24 includes a vector generator 81, distortion calculator 82, representative vector dictionary 83, minimum distortion searcher 84 and code-word extractor 85. A decoding section shown in FIG. 25 includes a representative vector dictionary 91.

In the above encoding section, when an input signal is sequentially input to the vector generator 81 via an input terminal 80 and K input signals are obtained, a K-dimensional input vector $x=\{x_k; k=1, \ldots, K\}$ (it is a scalar when K=1) is constructed and the input vector x is supplied to the distortion calculator 82.

In the distortion calculator 82, a distortion $d_l$ between the input vector x and the first representative vector $y_l$ of the representative vector dictionary 83 is first derived. In this example, "square distortion" is used as the distortion measure.

Likewise, in the succeeding processes, distortions $d_l$ between the input vector x and the second and succeeding representative vectors $y_l$ . . . of the representative vector dictionary 83 are derived. Then, the minimum distortion $d_l$* among the distortions $d_l$ derived by the distortion calculator 82 is searched for by the minimum distortion searcher 84 and a representative vector $y_l$* corresponding to the minimum distortion $d_l$* is supplied to the code-word extractor 85. In the code-word extractor 85, a corresponding code-word $_l$* is extracted based on the representative vector $y_l$* and is output from an output terminal 86.

In the decoding section, the code-word $_l$* supplied from the encoding section as described above and input via an input terminal 90 is used, and a representative vector $y_l$* corresponding to the code-word $_l$* is searched for in the representative vector dictionary 91 and output from an output terminal 92 as an output signal.

Generally, the performance of the vector quantization apparatus is determined by the representative vector dictionaries 83 and 91. Further, the design algorithm of the representative vector dictionaries 83 and 91 is a serious problem for the performance.

In order to cope with the above problem, an "LBG-algorithm" reported by Linde et al. is generally used. The above design algorithm is described in the following document in detail.

Y. Linde, A. Buzo and R. M. Gray, "An Algorithm for Vector Quantizer Design", IEEE Trans. Comm., COM-28-1, pp 84–95, 1980.

The content of the above document is briefly described.

In this case, a sufficiently large training series $T=\{tn; n=1, 2, \ldots, N\}$ which reflects the statistical characteristic of to-be-quantized data is prepared and a representative vector dictionary Y which minimizes a total distortion value D expressed by the following equation (d) between the training series T and the set $Y=\{y_l; l=1, 2, \ldots, L\}$ of the representative vector $y_l$ is derived by the repeat operation.

$$D=\frac{1}{N}\sum_{n=1}^{N} \min_{l \in L} d(tn, y_l) \tag{d}$$

After this, if the total distortion value obtained in the m-th cycle is Dm, a set of Y obtained when the following conditional expression (e) is satisfied is determined as the representative vector dictionary.

$$\frac{D_{m-1}<D_m}{D_m} < \epsilon \quad \epsilon\text{: constant } m \geqq 1 : D0=\infty \tag{e}$$

where $\epsilon$ is a constant, $m \geqq 1$, and $D0=\infty$.

As described above, in the prior art, the "LBG-algorithm" is considered as a method for designing a representative vector dictionary. According to the representative vector dictionary designed by use of the LBG-algorithm, a quasi-optimum performance can be ensured for a bias of the statistical distribution of the training series used for the designing process.

Therefore, if the "bias" of the statistical distribution of an input signal train is similar to the bias of the statistical distribution of the training series, and, if the bias does not vary with time, the fixed representative vector dictionaries designed by use of the above algorithms may have an excellent quantization performance.

In practice, however, a problem occurs when the fixed representative vector dictionary designed by use of the "LBG-algorithm" is applied to the encoding section and decoding section. That is, when a speech signal spectrum is given as an input signal to the encoding section, the bias of the statistical distribution of the signal train may be changed with time by the characteristic of the speech signal spectrum. As a result, an excellent quantization performance obtained by the representative vector dictionary cannot be exhibited and a quantization error will be increased.

SUMMARY OF THE INVENTION

An object of the present invention is to provide a speech encoding apparatus capable of obtaining an adaptive code book group corresponding to the feature of the input signal by selecting one from a plurality of adaptive code books according to the feature of the input signal, and then storing the driving signal obtained in the adaptive code book selected.

Another object of the present invention is to provide a learning-type speech encoding apparatus capable of synthesizing a higher-quality speech at a limited bit rate as low as less than 8 kbps.

The foregoing objects are accomplished by providing a speech encoding apparatus comprising: a plurality of code books (adaptive code books) that store driving signals as code-words; searching means for searching the code book group for the optimum driving signal on the basis of the input speech signal; a synthesizing filter for synthesizing a speech signal using the optimum driving signal obtained at the searching means; delay means for delaying the driving signal vector read from the code book group; and means for storing the driving signal delayed at the delay means in the code book of the code book group which was used to obtain the optimum driving signal.

The means for searching for the optimum driving signal looks through all driving signal vectors in the adaptive code book group to find one that will possibly minimize the error with respect to the input signal. Alternately, an adaptive code book to be searched is selected according to the feature obtained by analyzing the input speech signal, and the selected adaptive code book is searched for a driving signal that will possibly minimize the error with respect to the input signal.

In another approach, the adaptive code book selected in the preceding frame is searched for a driving signal that will possibly minimize the error with respect to the input, and all of the adaptive code book group except for the one selected in the preceding frame are searched for a driving signal that will possibly minimize the error with respect to the input. If the difference between these errors is below a specified threshold, the driving signal obtained from the adaptive code book selected in the preceding frame is chosen, and if not, the driving signal obtained from the adaptive code books other than the one selected in the preceding frame is chosen.

In still another approach, there are two searching states: the all code book searching and the particular code book searching. If the all code book searching state is selected, either of the above-described driving signal searching means is used to search the adaptive code book group for a driving signal that minimizes the error with respect to the input signal, and if the particular code book searching state is selected, the adaptive code book used in the preceding frame is forced to undergo the search for a driving signal that minimizes the error with respect to the input signal.

With the present invention, all driving signal vectors in the adaptive code book group are looked through to find one that will possibly minimize the error with respect to the input signal. Alternately, an adaptive code book to be searched is selected according to the feature obtained by analyzing the input speech signal, and the selected adaptive code book is searched for a driving signal that will possibly minimize the error with respect to the input signal. After the search, the encoding of the retrieved signal is done, and the resulting driving signal is stored in the code book selected. This makes it possible to provide the adaptive code book group corresponding to the feature of the input signal. As a result, the capability of the adaptive code books is improved. For portions where the feature of the input signal has changed, the adaptive code book corresponding to the feature is selected at the time of encoding, thereby improving the quality of encoding.

Further, the adaptive code book selected in the preceding frame is searched for a driving signal that will possibly minimize the error with respect to the input, and all of the adaptive code book groups except for the one selected in the preceding frame are searched for a driving signal that will possibly minimize the error with respect to the input. If the difference between these errors is below a specified threshold, the driving signal obtained from the adaptive code book selected in the preceding frame is chosen, and if not, the driving signal obtained from the adaptive code books other than the one selected in the preceding frame is chosen.

This approach prevents the selected adaptive code books from changing frequently in a short time, thereby avoiding the presence of more than one adaptive code book reflecting the similar feature of the input.

Still further, there are two searching states: the all code book searching and the particular code book searching. If the all code book searching state is selected, either of the above-described driving signal searching means is used to search the adaptive code book group for a driving signal that minimizes the error with respect to the input signal, and if the particular code book searching state is selected, the adaptive code book used in the preceding frame is forced to undergo the search for a driving signal that minimizes the error with respect to the input signal.

In this approach, the adaptive code book select information is sent to the decoder only in the all code book searching state, thereby preventing the adaptive code book select information from increasing the amount of codes.

With the present invention, the optimum driving signal vector retrieved from the adaptive code book, or the driving signal vector actually used in encoding by driving the synthesizing filter, is used as a training vector. Driving signal vectors in the adaptive code book, more specifically, the representative vectors selected from the driving signal vectors on the basis of a specified reference are constantly corrected according to the training vector. This is done in parallel with the encoding each time a new driving signal vector is looked for.

In this way, by the learning process where the driving signal vectors are constantly corrected, the driving signal vectors in the adaptive code book constantly change into vectors that allow more accurate synthesis of the speaker's voice. As a result, it is possible to synthesize a high-quality speech even at a low bit rate, for example, on the order of 8 kbps or less.

Another object of this invention is to provide a speech encoding apparatus capable of effecting the vector quantization of a high performance with less of a quantization error.

In order to attain the above object, an encoding section or decoding section of this invention capable of updating sequentially changing the contents of a representative vector dictionary according to a variation with time in the bias of the statistical distribution of input signal train is constructed by the following constituents. That is, an encoding section is constructed by a representative vector dictionary having a plurality of representative vectors stored therein; a vector generator for generating an input vector based on an input signal; a minimum distortion searcher for searching for a minimum distortion from distortions between the input vector generated by the vector generator and the representative vectors stored in the representative vector dictionary; a code-word extractor for extracting a code-word of the representative vector of the representative vector dictionary which corresponds to the minimum distortion searched for by the minimum distortion searcher; a training-signal setting unit for setting the input vector generated by the vector generator to a training signal; an updating area specifying unit for specifying an updating area of the representative vector dictionary based on the representative vector corresponding to the code-word extracted by the code-word extracting means; and an updating unit for updating a representative vector contained in the updated area specified by the updating area specifying unit by use of the training signal set by the training-signal setting unit.

An encoding section provided as another example of this invention is constructed by a representative vector dictionary having a plurality of representative vectors stored therein; a vector generator for generating an input vector based on an input signal; a minimum distortion searcher for searching for a minimum distortion from distortions between the input vector generated by the vector generator and the representative vectors stored in the representative vector dictionary; a code-word extractor for extracting a code-word of the representative vector of the representative vector dictionary which corresponds to the minimum distortion searched for by the minimum distortion searcher; a training-signal setting unit for setting the representative vector of the representative vector dictionary corresponding to the minimum distortion searched for by the minimum distortion searcher to a training signal; an updating area specifying unit for specifying an updating area of the representative vector dictionary based on the representative vector corresponding to a code-word extracted by the code-word extractor; and an updating unit for updating a representative vector contained in the updated area specified by the updating area specifying unit by use of the training signal set by the training-signal setting unit.

Further, this invention is constructed as follows as still another example. That is, an encoding section is constructed by a representative vector dictionary having a plurality of representative vectors stored therein; a vector generator for generating an input vector based on an input signal; a minimum distortion searcher for searching for a minimum distortion from distortions between the input vector generated by the vector generator and the representative vectors stored in the representative vector dictionary; a code-word extractor for extracting a code-word of the representative vector of the representative vector dictionary which corresponds to the minimum distortion searched for by the minimum distortion searcher; an updating/initialization/continuation specifying unit for selectively specifying one of the "updating", "initialization" and "continuation in the present state" of the representative vector dictionary; a training-signal setting unit for setting the representative vector of the representative vector dictionary corresponding to the minimum distortion searched for by the minimum distortion searcher when the updating of the representative vector dictionary is specified by the updating/initialization/continuation specifying unit to a training signal; an updating area specifying unit for specifying an updating area of the representative vector dictionary based on a representative vector corresponding to a code-word extracted by the code-word extractor when the updating of the representative vector dictionary is specified by the updating/initialization/continuation specifying unit; an updating unit for updating a representative vector contained in the updated area specified by the updating area specifying unit by use of the training signal set by the training-signal setting unit; a representative vector dictionary initializing unit for initializing the representative vector dictionary when the initialization of the representative vector dictionary is specified by the updating/initialization/continuation specifying unit; and a unit for maintaining the present state of the representative vector dictionary when the continuation of the representative vector dictionary is specified by the updating/initialization/continuation specifying unit.

As described above, according to this invention, the training signal is set by the input vector constructed by input signals or the representative vector of the representative vector dictionary which causes the distortion with respect to the input vector to be a minimum. At the same time, the updating area of the representative vector dictionary is determined by the representative vector corresponding to the code-word of the minimum distortion representative vector of the representative vector dictionary which has the smallest distortion with respect to the input vector. Since the representative vector contained in the updating area can be updated by use of the training signal, it is possible to always maintain the state in which the contents of the representative vector dictionary can be continuously checked even when the bias of the statistical distribution of input signal train varies with time.

Further, by simply specifying the operation of updating the representative vector dictionary, initializing the representative vector dictionary or maintaining the present state of the representative vector dictionary, it becomes possible to effect the periodic resetting operation in addition to the updating operation of the representative vector dictionary according to the thus specified operation.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Embodiment 1

Figure 1:
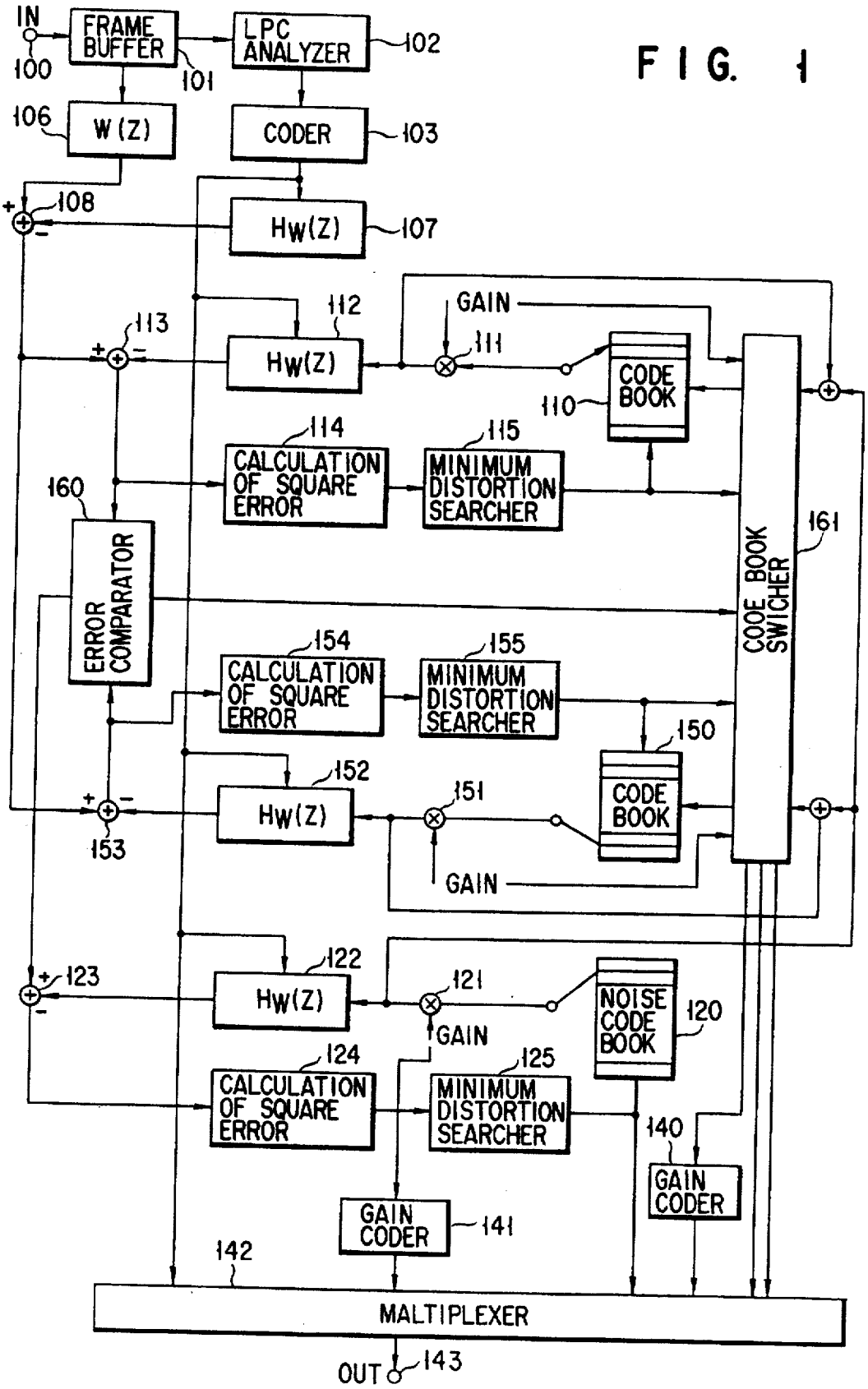
FIG. 1 is a block diagram of a speech encoding apparatus according to a first embodiment of the present invention.

FIG. 1 is a block diagram of a speech encoding apparatus according to an embodiment of the present invention.

In FIG. 1, an input speech signal is supplied from an input terminal 100 to a frame buffer 101. The frame buffer 101 segments an input speech signal train in units of L samples, and then stores each resulting unit as a frame of signal. L is normally 160. A frame of the input speech signal train from the frame buffer 101 is supplied to an LPC analyzing circuit 102 and a weighting filter 106.

The LPC analyzing circuit 102 performs LPC (Linear Predictive Coding) analysis of the input speech signal by using, for example, an auto-correlation method, and then extracts P LPC prediction coefficients $\{\alpha i: i=1, 2, \ldots, p\}$, or P reflection coefficients $\{ki: i=1, 2, \ldots, p\}$. The extracted prediction coefficients or reflection coefficients are encoded in a specified number of bits at an encoding circuit 103, and then used at the weighting filter 106 and weighting synthesizing filters 107,112, 122, and 152.

The weighting filter 106 assigns weights to the input speech signal train when an adaptive code book B 150 and a noise code book 120 are searched for a driving signal vector of the synthesizing filter. The transfer function H(z) of the synthesizing filters 107, 112, 152, and 122 is expressed by equation (1). At this time, the transfer function W(z) of the weighting filter 106 is expressed as:

$$W(z)=\frac{H(Z/\gamma)}{H(z)} \tag{2}$$

where $\gamma$ is a parameter that controls the magnitude of weighting ($0 \leqq \gamma \leqq 1$). The weighting synthesizing filters 112, 152, and 122 are filters consisting of a cascade connection of a synthesizing filter with a transfer function of H(z) and a weighting filter with a transfer function of w(z). Their transfer function $H_w(z)$ is expressed as:

$$H_w(z)=H(z/\gamma) \tag{3}$$

As in this embodiment, use of the weighting filter 106 enables auditory encoding distortion to be reduced. The embodiment has the weighting filter 106 placed outside the driving signal vector-searching loop, which decreases the amount of calculations required for the searching.

To prevent the weighting synthesizing filters 112, 152, and 122 from having an adverse effect on the search for the driving signal vector, the weighting synthesizing filter 107 has an initial memory. The weighting synthesizing filter 107 has the initial state set to the internal state kept by the weighting synthesizing filters 112, 152, and 122 at the end of the preceding frame.

The zero input response vector is produced at the weighting synthesizing filter 107, and at a subtracter 108, is subtracted from the output of the weighting filter 106. This allows the initial state of the weighting synthesizing filters 112, 152, and 122 to be made zero, which enables the search for the driving signal vector without considering the effect of the preceding frame.

The above-described processing is done in frames without exceptions.

Next will be explained the process of dividing the frame into M subframes (normally, M=4) and then searching for the driving signal vector in the subframes.

In the search for the driving signal vector, the adaptive code book is first searched, and then the noise code book 120 is searched. The way of searching an adaptive code book A 110 will be explained. The searching of the adaptive code book B 150 and the noise code book 120 is done in the same manner as the adaptive code book.

The driving signal vectors Xj (the dimension of which is L/M=K) corresponding to a pitch period of j are read in sequence from the adaptive code book 110. Then, after the Xj is multiplied by a gain of $\beta$ at a multiplier 111, it is supplied to the weighting synthesizing filter 112, which performs a filtering operation to produce a synthetic speech vector.

On the other hand, the input speech signal read from the frame buffer 101 is assigned a weight at the weighting filter 106. The effect of the preceding frame is subtrated from the weighted speech signal at the subtracter 108. Using the speech signal vector Y from the subtracter 108 as the target vector, the subtracter 113 computes the error vector $E_j$ with respect to the synthetic speech vector from the weighting synthesizing filter 112. A square error computing circuit 114 calculates the square sum $\|E_j\|$ of errors. A minimum distortion searching circuit 115 detects the minimum value of the $\|E_j\|$ and an index j that provides the minimum value. The index j is given as jA to a code book changeover circuit 161.

Specifically, the error vector $E_j$ is expressed by the following equation (4). By partially differentiating the error vector $\|E_j\|$ with respect to β and equalizing the resulting expression to zero, the minimum value of $\|E_j\|$ in optimizing β is expressed by equation (5) where β is a gain assigned by the multiplier 111. The gain is expressed as βA and then supplied to the code book changeover circuit 161.

$$E_j = Y - \beta H X_j \tag{4}$$

$$\|E_j\|_{min} = \|Y\| - \frac{(Y, HX)^2}{\|HX_j\|} \tag{5}$$

where $\|X\|$ is a square norm, (X, Y) an inner product, and H the impulse response matrix of a weighting synthesizing filter (whose transfer function is $H_w(z)$) expressed by equation (6):

$$H = \begin{bmatrix} h(1) & & \\ h(2) & h(1) & \\ h(3) & h(2) & h(1) & 0 \\ \cdot & & & \cdot \\ \cdot & & & \cdot \\ \cdot & & & \cdot \\ h(k) & h(k-1) & \dots & h(1) \end{bmatrix} \tag{6}$$

As seen from equation (5), the searching of the adaptive code book 110 for the driving signal vector is done by computing the second term on the right-hand side of equation (5) for every code-word $X_j$, and detecting an index j for the maximum code-word.

Similarly, the optimum index $j_B$ and gain $\beta_B$ for the target signal Y of the adaptive code book B 150 are computed and then supplied to the code book changeover circuit 161.

An error comparator circuit 160 compares the minimum square error $E_A$ of the adaptive code book A 110 with the minimum square error $E_B$ of the adaptive code book B 150. If $E_A \leqq E_B$, it supplies an adaptive code book select signal S=0 to the code book changeover circuit 161, and if $E_A < E_B$, it supplies the select signal S=1.

The code book changeover circuit 161, if the adaptive code book select signal from the error comparator circuit 160 is S=0, supplies index $j_A$ together with the adaptive code book select signal S to a multiplexer, which is also supplied with gain $\beta_A$ supplied from the changeover circuit and then encoded at a gain encoding circuit 140. After the optimum driving signal vector $X_{Aopt}$ has been retrieved from the adaptive code book 110, the output of the weighting synthesizing filter 112 corresponding to $X_{Aopt}$ is subtracted from the target vector Y at the subtracter 113. The output of the subtracter 113 becomes the target vector of the noise code book 120.

Conversely, if the adaptive code book select signal from the error comparator circuit 160 is S=1, the code book changeover circuit 161 supplies index jB together with the adaptive code book select signal S to the multiplexer 142, which is also supplied with gain $\beta_B$ supplied from the changeover circuit and encoded at the gain encoding circuit 140. After the optimum driving signal vector $X_{Bopt}$ has been retrieved from the adaptive code book 150, the output of the weighting synthesizing filter 112 corresponding to $X_{Bopt}$ is subtracted from the target vector Y at the subtracter 153. The output of the subtracter 153 becomes the target vector of the noise code book 120.

The searching of the noise code book 120 for the noise vector is done in the same way as the searching of the adaptive code book for the driving signal vector. If the code vector retrieved from the noise code book 120 is $N_{opt}$, the driving signal vector of the synthesizing filter will be expressed as:

$$X = \beta_A \cdot X_{Aopt} + g \cdot N_{opt} \text{ (when } S=0)$$

or $$X = \beta_B \cdot X_{Bopt} + g \cdot N_{opt} \text{ (when } S=1)$$

where $\beta_A$, $\beta_B$, and g are respectively gains to be assigned to the driving signal vectors and the noise vector retrieved from the adaptive code book A 110, adaptive code book B 150, and noise code book 120.

Then, the driving signal vector X, if the adaptive code book select signal S is S=0, is stored in the adaptive code book A 110, and if S=1, is stored in the adaptive code book B 150.

The encoded parameters obtained from the above-described processes are multiplexed at the multiplexer 142, and the resulting signal is supplied as the encoded output from the output terminal 143 to the transmission line. Specifically, the multiplexer 142 multiplexes the following: the code obtained from the encoding circuit 103 that encodes the information on the LPC prediction coefficient created by the LPC analyzing circuit 102; the adaptive code book select signal obtained from the error comparator circuit 160; the index code in the adaptive code book A 110 or B 150 obtained at the minimum distortion searching circuit 115 or 155; the code obtained from the gain encoding circuit 140 that encodes the information on a gain to be multiplied at the multiplier 111 or 151; the index code in the noise code book 120 obtained at the minimum distortion searching circuit 125; and the code obtained from the gain encoding circuit 141 that encodes the information on a gain to be multiplied at the multiplier 121.

The construction of a speech decoding apparatus corresponding to the FIG. 1 speech encoding apparatus will be explained, referring to FIG. 2.

Figure 2:
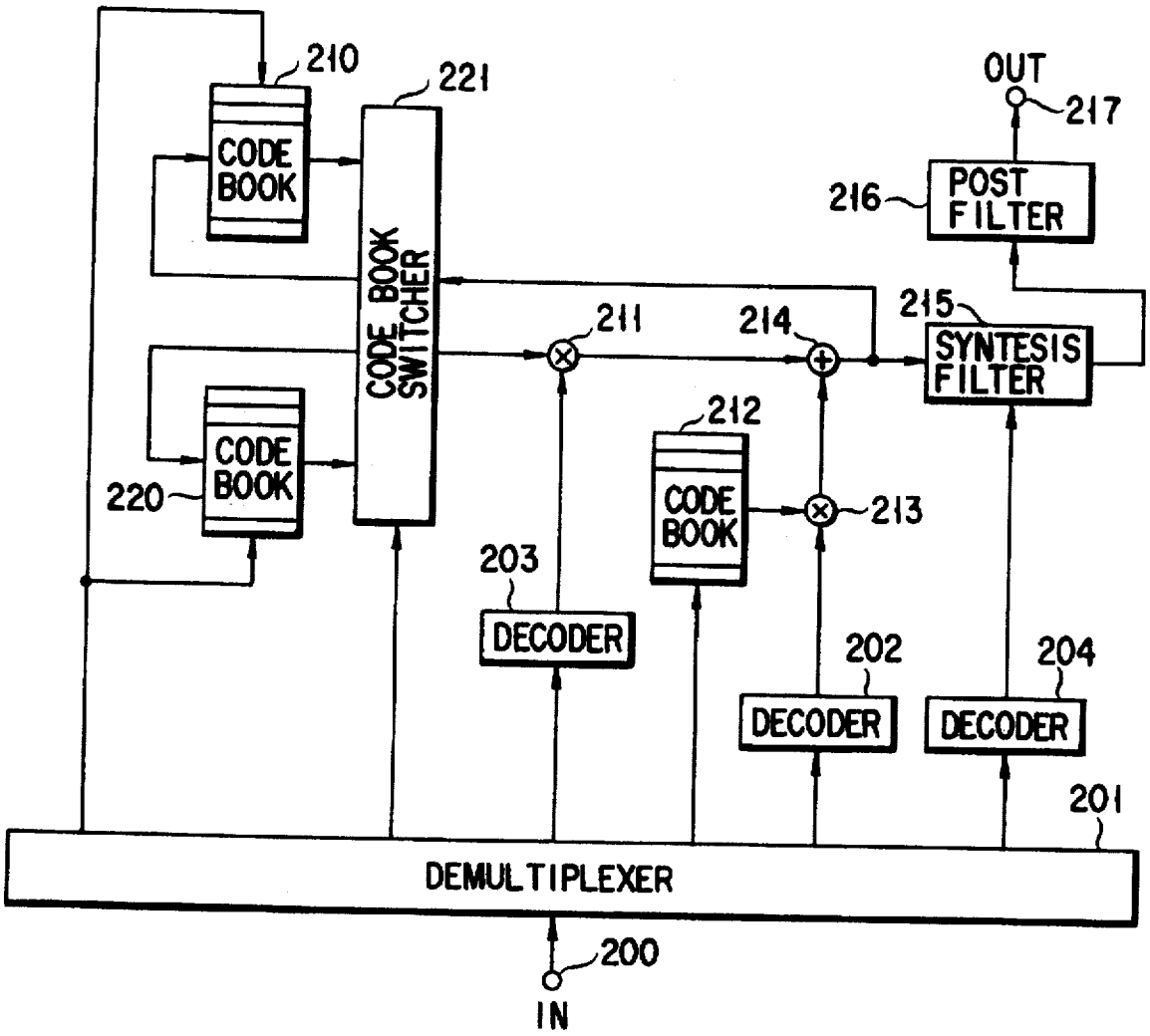
FIG. 2 is a block diagram of a speech decoding apparatus according to the first embodiment.

In FIG. 2, the encoded parameter supplied to an input terminal 200 is broken down by a demultiplexer 201 into respective parameters, which are then decoded by decoders 202, 203, and 204. The decoded adaptive code book select signal is supplied to a code book changeover circuit 221, which, based on the select signal, selects adaptive code books to be used, and produces a driving signal based on the index and gain in the adaptive code book, and the index and gain in the noise code book. By filtering the driving signal at a synthesizing filter 215, a synthetic speech signal is produced. The synthetic speech signal has its spectrum shaped at a post filter 216 to suppress auditory distortion, and then the resulting signal is supplied from the output terminal 217.

Then, the code book changeover circuit 221 operates based on the adaptive code book select signal so that the driving signal may be stored in either an adaptive code book A 210 or adaptive code book B 210.

Figure 23A:
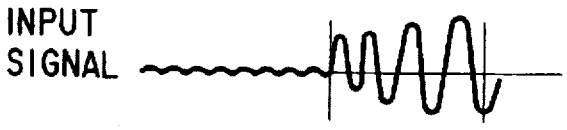
FIG. 23A (PRIOR ART)
FIG. 23A shows the input signal changing from the unvoiced section to the voiced section in the prior art, FIG. 23B the state of the adaptive code book of the prior art, and FIG. 23C a conceptual diagram of the first embodiment of the present invention.
Figure 23B:
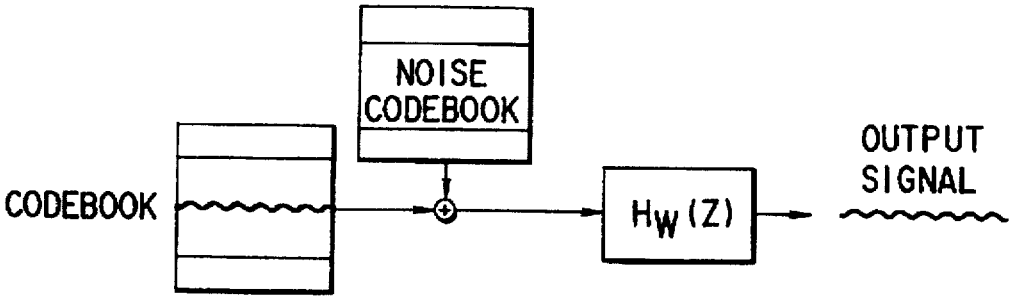
FIG. 23B (PRIOR ART)
Figure 23C:
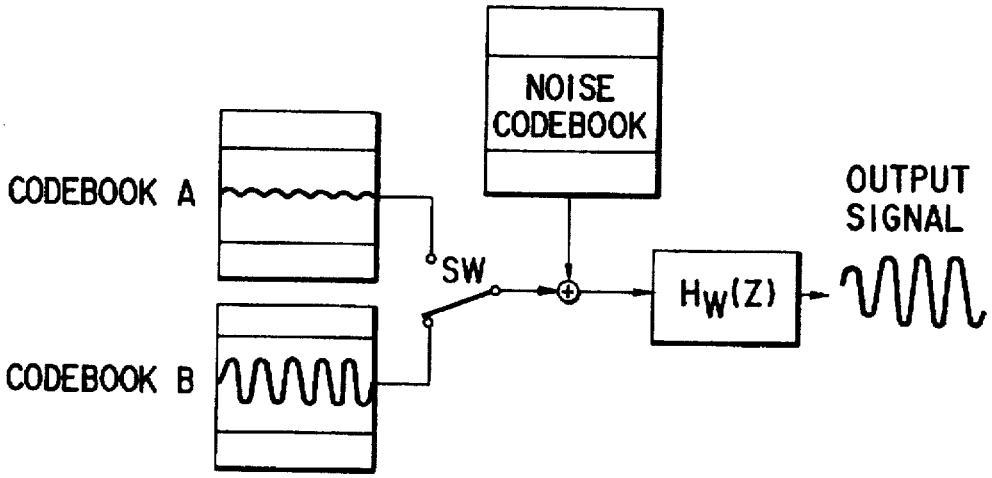
FIG. 23C (PRIOR ART)
Figure 24:
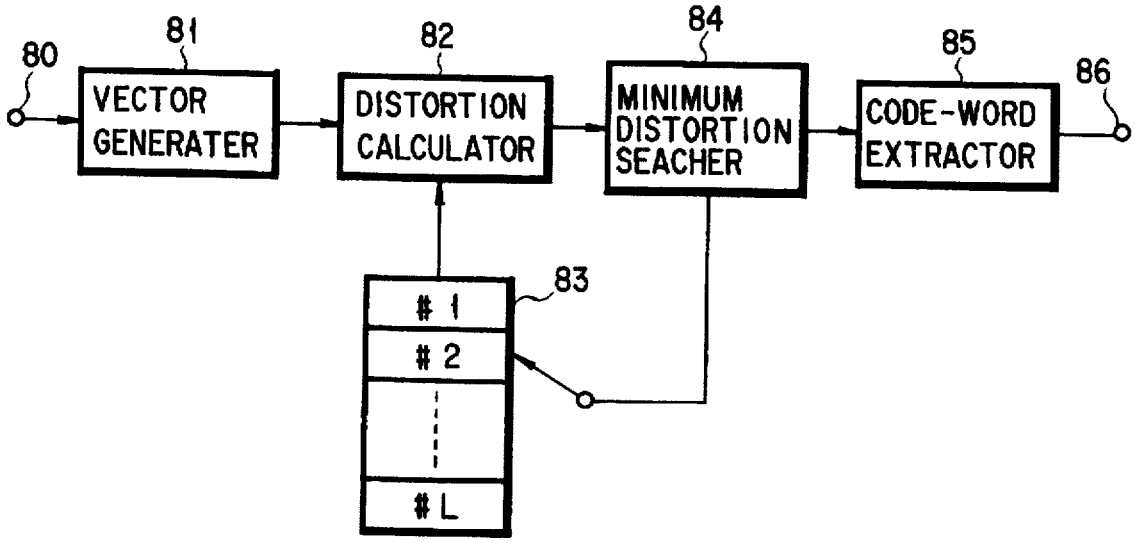
F I G. 24 (PRIOR ART)
FIG. 24 is a construction block diagram showing an example of an encoding section of the conventional quantizing apparatus.
Figure 25:
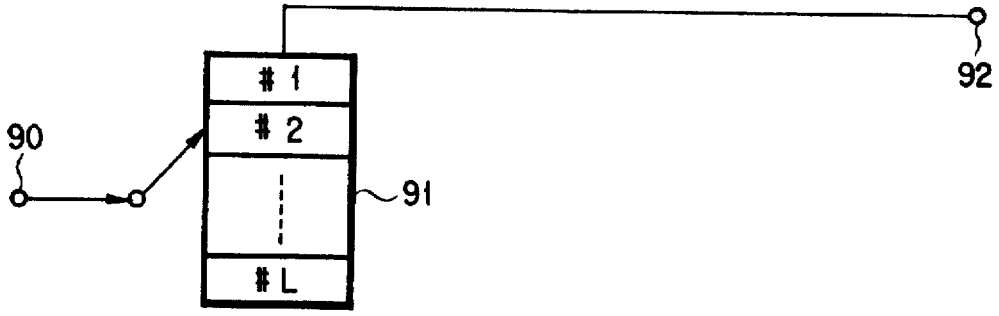
F I G. 25 (PRIOR ART)
FIG. 25 is a construction block diagram showing an example of a decoding section of the conventional quantizing apparatus.
Figure 26:
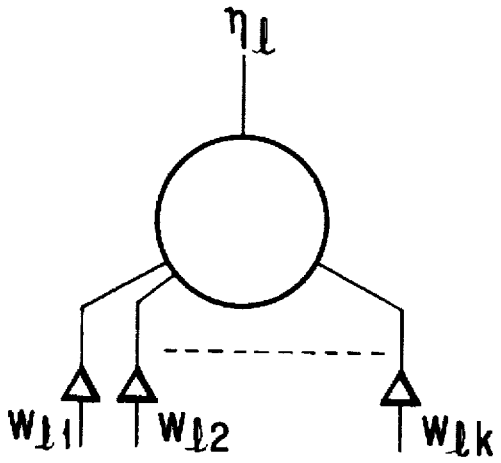
FIG. 26 is a conceptional diagram for illustrating the design algorithm for a representative vector dictionary.
Figure 27:
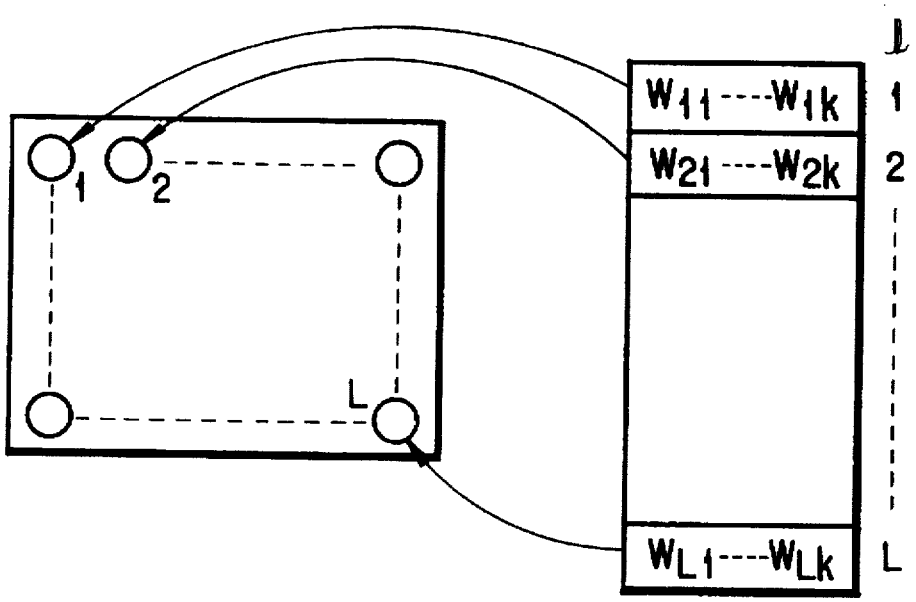
FIG. 27 is a two-dimensional plane view for illustrating the design algorithm for a representative vector dictionary.

Using a concrete example, the present embodiment will be compared with a conventional equivalent. FIGS. 23A, 23B, and 23C illustrate the input signal, the state of the adaptive code book of the prior art, and the state of the adaptive code book group of the present embodiment.

respectively. FIG. 23A shows a typical example of the input signal changing from an unvoiced section to a voiced section.

In the prior art, the adaptive code book is in a state reflecting the feature of the unvoiced section, so that the effect of the input signal in the voiced section can hardly be expected. With the help of the noise code book, the adaptive code book gradually changes into a state reflecting the feature of the voiced section. However, because the encoding has continued for a long time in the situation where the capability of the adaptive code book is decreased, the quality of synthetic speech obtained is poorer.

In contrast, the present embodiment has two adaptive code books, which are already in the voiced section state and the unvoiced section state respectively, reflecting the features of the past input signals. This allows a large effect of the adaptive code book to be expected since the adaptive code book reflecting the feature of the voiced section is selected even if the feature of the input signal changes from the unvoiced section to the voiced section.

It may be inferred easily that there is a similar tendency when the input signal changes from the voiced section to the unvoiced section.

Embodiment 2

Figure 3:
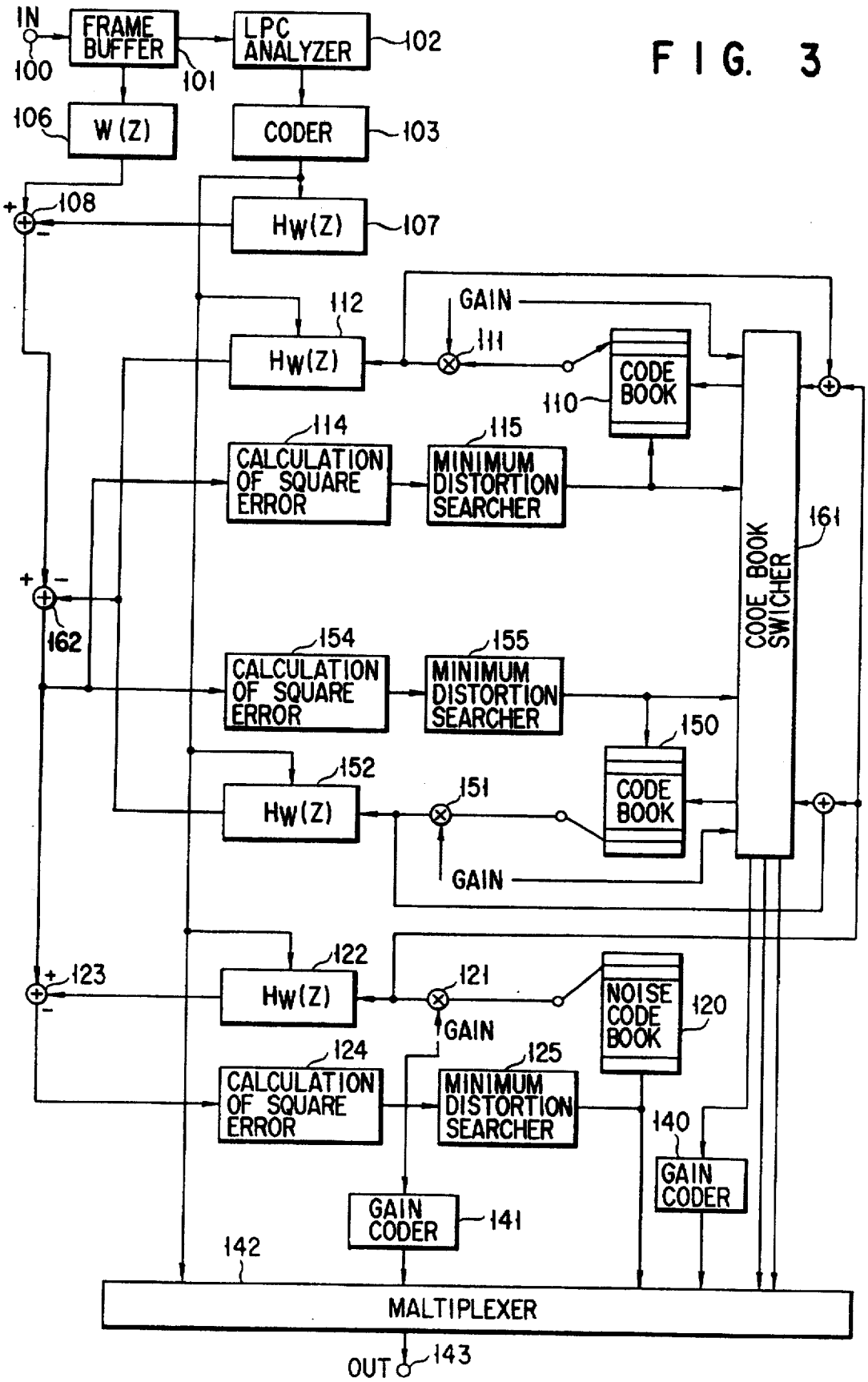
FIG. 3 is a block diagram of a speech encoding apparatus according to a second embodiment of the present invention.

FIG. 3 is a block diagram of a speech encoding apparatus according to a second embodiment of the present invention. The present embodiment differs from the preceding embodiment in the method of selecting the adaptive code book. Because the circuits indicated by the same numerals in FIGS. 1 and 3 have the same functions, their explanation will be omitted.

In the method of selecting the adaptive code book in the previous embodiment, the adaptive code book A 110 and adaptive code book B 150 are searched for a driving signal that minimizes the square error. In contrast, with the present embodiment, the feature of the input signal is analyzed, and depending on the magnitude of feature, the adaptive code book to be used is determined in an open loop. For feature analysis, the judgment between voiced sound and unvoiced sound can be considered, for example.

A voiced/unvoiced sound judgment circuit 163 analyzes the input signal to determine whether it is a voiced sound or an unvoiced sound. If it is judged to be a voiced sound, the adaptive code book select signal S is made S=0, and if it is judged to be an unvoiced sound, the select signal S is made S=1. The resulting signal is sent to the adaptive code book changeover circuit, which searches the adaptive code book A 110 for a driving signal that minimizes the square error for the target signal Y, when the adaptive code book select signal is S=0. When the adaptive code book select signal is S=1, it searches the adaptive code book B 150. The driving signal retrieved is stored in the adaptive code book selected.

In this way, since the adaptive code book to be searched can be selected from the input signal, the number of searches of the adaptive code book required is just one, thereby reducing the amount of calculations. Because the speech decoding apparatus in the present embodiment has the same construction as that of FIG. 2, its explanation will be omitted.

Embodiment 3

Figure 4:
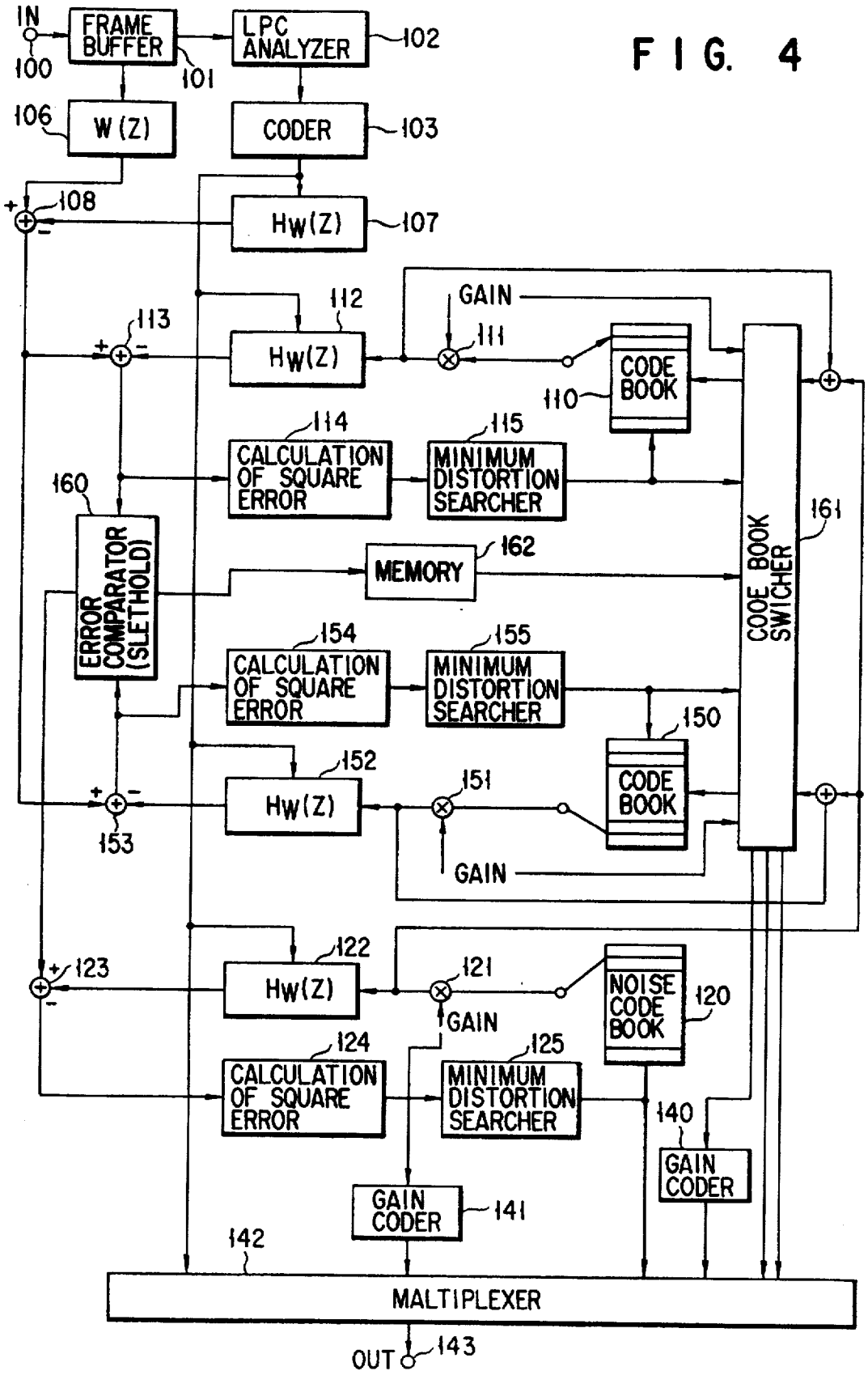
FIG. 4 is a block diagram of a speech encoding apparatus according to a third embodiment of the present invention.

FIG. 4 is a block diagram of a speech encoding apparatus according to a third embodiment of the present invention. The present embodiment differs from the first embodiment in the method of selecting the adaptive code book. Because the circuits indicated by the same numerals in FIGS. 1 and 4 have the same functions, their explanation will be omitted.

In the method of selecting the adaptive code book in the first embodiment, the adaptive code book A 110 and adaptive code book B 150 are searched for a driving signal that minimizes the square error. In contrast to this, with the present embodiment, the select information on the adaptive code book used for the preceding frame is stored in a memory 162; in searching for the present frame, the minimum square error obtained from the adaptive code book stored in the memory 162 is compared with the minimum square error obtained from the adaptive code book stored in a memory other than the memory 162; and if the difference is below a specified threshold, the adaptive code book stored in the memory 162 is selected, and if not, the adaptive code book other than that stored in the memory 162 is selected.

For example, if the information stored in the memory 162 indicates the adaptive code book A 110, the minimum square errors obtained by searching the adaptive code book A 110 and adaptive code book B 150 are $E_A$ and $E_B$, respectively, and the threshold is $\epsilon$, then When $E_A-E_B \leqq \epsilon$, adaptive code book A 110 is selected.

When $E_A-E_B > \epsilon$, adaptive code book B 150 is selected.

As with the above-described embodiment, the driving signal is stored in the selected adaptive code book.

In the above embodiment, there is a case where all adaptive code books are selected in a short time, in which case the states of the adaptive code books reflect similar features. This creates the problem of decreasing the overall capability of the adaptive code book group. In contrast, with the present embodiment, the adaptive code book used for the preceding frame is easier to select, thereby avoiding the above problem.

Because the speech decoding apparatus in the present embodiment has the same construction as that of FIG. 2, its explanation will be omitted.

Embodiment 4

Figure 5:
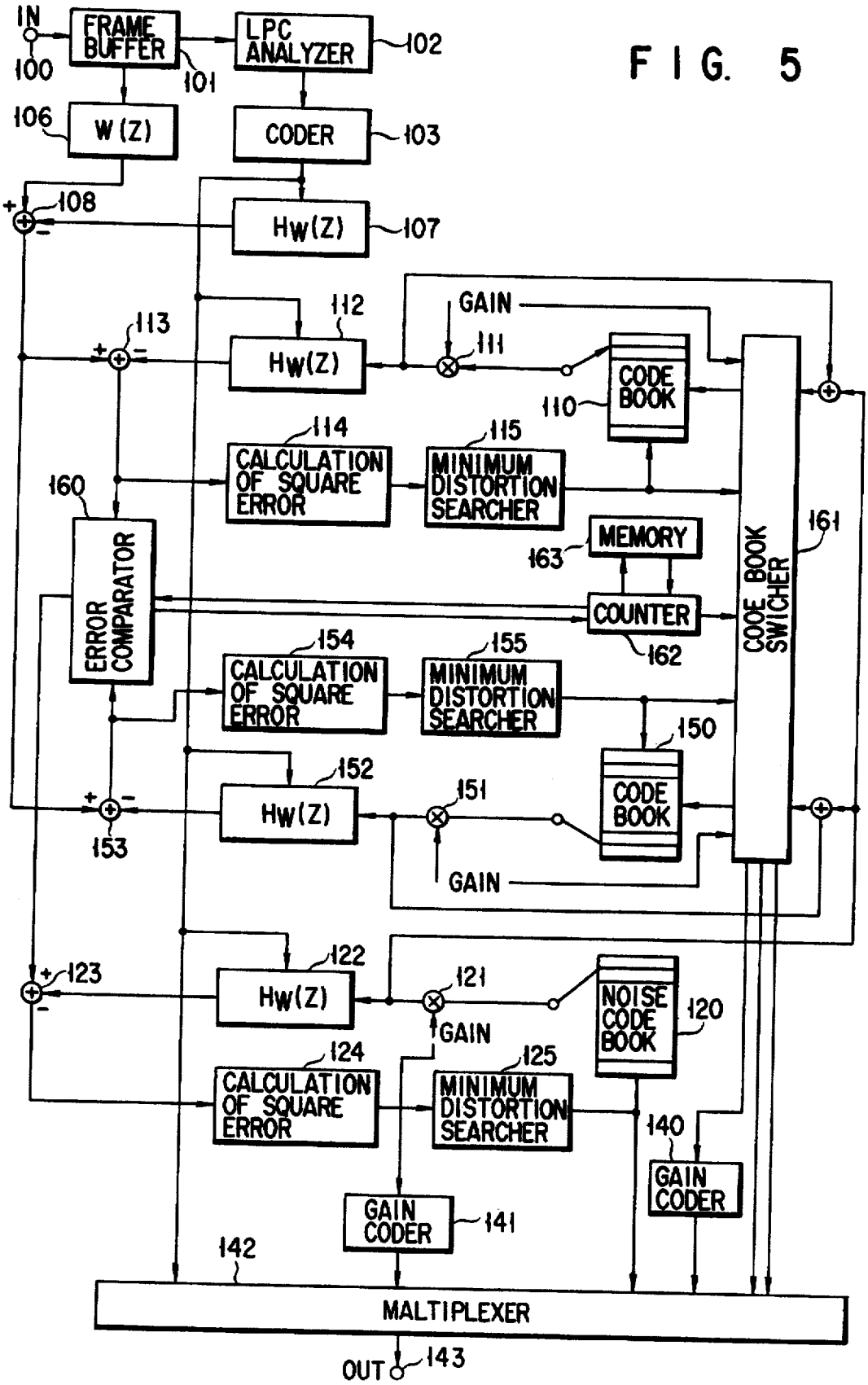
FIG. 5 is a block diagram of a speech encoding apparatus according to a fourth embodiment of the present invention.

FIG. 5 is a block diagram of a speech encoding apparatus according to a fourth embodiment of the present invention. The present embodiment differs from the first embodiment in the subframe period for selecting the adaptive code book. Because the circuits indicated by the same numerals in FIGS. 1 and 5 have the same functions, their explanation will be omitted.

In the above-described embodiment, the optimum adaptive code book is selected for each subframe, and the adaptive code book select signal S is supplied to the encoder side. This increases the amount of codes to be transferred. In contrast, with the present embodiment, by making use of the fact that the speech signal feature changes only slightly with respect to time, the optimum adaptive code book selected for a subframe is forced to apply to a plurality of subframes. This makes it possible to avoid an increase in the amount of codes to be transferred and the amount of calculations needed for the searching of the adaptive code book.

The counter 162 has an initial value of zero, and increases the count C by 1 each time the speech subframe to be processed is entered. When the count C reaches a given constant N, the counter resets to zero. Thus, the range that the count of the counter 162 can take is expressed by the following equation:

$$C=0 \text{ to } N-1 \text{ where } N \text{ is a given constent.}$$

The searching of the adaptive code book begins with the all code book-searching state. When the count of the counter 162 is zero, in searching all code books, the adaptive code book A 110 and adaptive code book B 150 are searched for the optimum driving signal, and the adaptive code book select signal S is stored in the memory 163, as described in the first embodiment. When the count C of the counter 162 has a value other than zero, only the adaptive code book stored in the memory 163 is searched for the driving signal in the particular code book-searching state. In the case of the particular code book-searching state, it is unnecessary to transfer the adaptive code book select signal S to the decoder.

While in the present embodiment, the searching method of the first embodiment is used as an example of a method of searching the adaptive code book when the count C of the counter 162 is zero, the searching methods of the second and third embodiments may be used.

The construction of a speech decoding apparatus corresponding to the FIG. 5 speech encoding apparatus will be explained, referring to FIG. 6. The circuits indicated by the same numerals in FIGS. 6 and 2 have the same functions as explained earlier, and their explanation will be omitted. Because the counter 230 and the memory 231 have the same functions as those of the counter 162 and memory 163 of FIG. 5, their explanation will be omitted.

Figure 6:
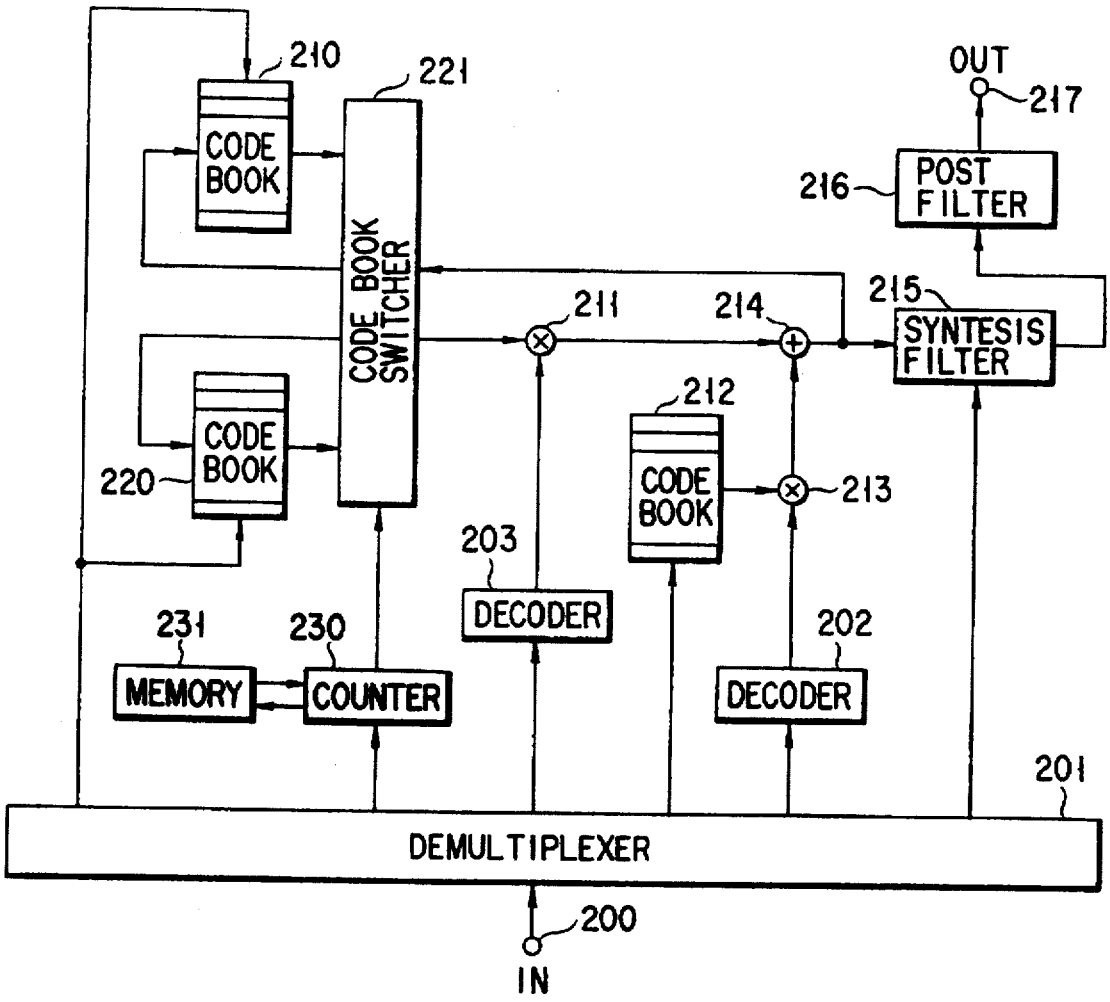
FIG. 6 is a block diagram of a speech decoding apparatus according to the fourth embodiment.

The decoder of FIG. 6, when the count C of the counter 230 is zero, supplies the adaptive code book select signal S transferred from the encoder to the adaptive code book changeover circuit 221. The memory 231 stores the adaptive code book select signal S. When the count C of the counter 230 assumes a value other than zero, since the adaptive code book select signal is not supplied, the decoder reads the adaptive code book select signal stored in the memory 231, and supplies it to the adaptive code book changeover circuit. In this way, it is possible to produce the driving signal and create a synthetic speech.

As described so far, with the present invention, a plurality of adaptive code books are provided to allow selection of adaptive code books for use in encoding according to the input signal. In updating the adaptive code book, the adaptive code book group corresponding to the feature of the input signal can be obtained by storing the driving signal in the selected adaptive code book. Because of this, even if the feature of the input signal changes, the adaptive code book whose state expresses the feature of the input signal well can be selected, with the result that the effectiveness of the adaptive code book increases. This improves the quality of the synthetic speech obtained.

Embodiment 5

Figure 7:
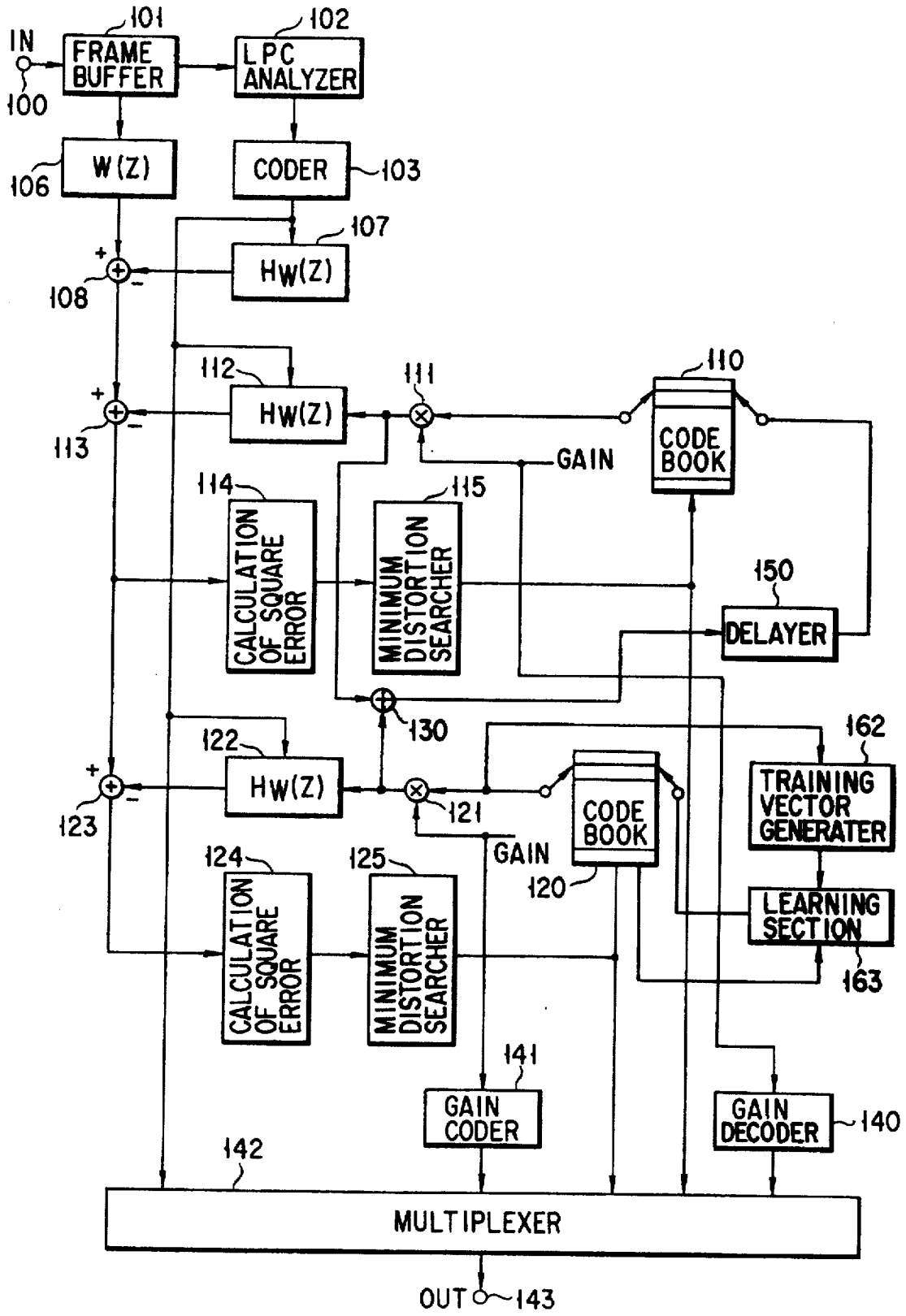
FIG. 7 is a block diagram of a learning-type speech encoding apparatus according to a fifth embodiment of the present invention.

FIG. 7 is a block diagram of a learning-type speech encoding apparatus according to a fifth embodiment of the present invention.

In FIG. 7, an input speech signal sampled at a specified sampling frequency (for example, 8 kHz) is supplied in frames to an input terminal 100. The input speech signal is then supplied to a frame buffer 101. The frame buffer 101 segments the input speech signal train in units of L samples (for example, L=160), and then stores each resulting unit as a frame of signal. A frame of the input speech signal from the frame buffer 101 is supplied to an LPC analyzing circuit 102 and a weighting filter 106.

The LPC analyzing circuit 102 performs LPC (Linear Predictive Coding) analysis of the input speech signal by using, for example, an auto-correlation method, and then extracts P LPC prediction coefficients $\{\alpha: i=1, 2, \ldots p\}$, or P reflection coefficients $\{ki: i=1, 2, \ldots, p\}$. The extracted prediction coefficients or reflection coefficients are encoded in a specified number of bits at an encoding circuit 103, and then used at the weighting filter 106 and weighting synthesizing filters 107,112, and 122.

The weighting filter 106 assigns weights to the input speech signal train when searching an adaptive code book 110 and a noise code book 120 for the driving signal vector of the synthesizing filter. The transfer function H(z) of synthesizing filters 107, 112, and 122 is expressed by equation (1). At this time, the transfer function W(z) of the weighting filter 106 is expressed by equation (2):

$$W(z) = \frac{H(Z/\gamma)}{H(z)} \tag{2}$$

where $\gamma$ is a parameter for controlling the magnitude of weighting ($0 \leqq \gamma \leqq 1$).

The weighting synthesizing filters 107, 112, and 122 are filters consisting of a cascade connection of a synthesizing filter with a transfer function of H(z) expressed by equation (1) and a weighting filter with a transfer function of W(z). Their transfer function $H_w(z)$ is expressed by equation (3):

$$H_w(z)=H(z/\gamma) \tag{3}$$

As in this embodiment, use of the weighting filter 106 enables auditory encoding distortion to be reduced. The embodiment has the weighting filter 106 placed outside the driving signal-searching loop, which decreases the amount of calculations required for the searching.

To prevent the weighting synthesizing filters 112 and 122 from having an adverse effect on the search for the driving signal vector, the weighting synthesizing filter 107 with an initial memory is provided. This weighting synthesizing filter 107 has the initial state set to the internal state kept by the weighting synthesizing filters 112 and 122 at the end of the preceding frame.

The zero input response vector is produced at the weighting synthesizing filter 107, and at a subtracter 108, is subtracted from the output of the weighting filter 106. This allows the initial state of the weighting synthesizing filters 112 and 122 to be made zero, which enables the search for the driving signal vector without considering the effect of the preceding frame.

The above-described processing is done in frames with out exceptions.

Next will be explained the process of dividing the frame into M subframes (normally, M=4) and then searching for the driving signal vector in the subframes.

In the search for the optimum driving signal vector, the adaptive code book 110 is first searched, and then the noise code book 120 is searched. The adaptive code book 110 stores a plurality of K-dimensional driving signal vectors (K=L/M), for example, 128 vectors. In searching for the driving signal vector, the driving signal vectors Xj specified by index j explained later are sequentially read from the adaptive code book 110. Then, after the Xj is multiplied by a gain of $\beta$, it is supplied to the weighting synthesizing filter 112, which performs a filtering operation on the driving signal vector multiplied by gain $\beta$ to produce a synthetic speech vector.

On the other hand, the input speech signal read from the frame buffer 101 is assigned a weight at the weighting filter 106. Then, the effect of the preceding frame is subtracted from the weighted speech signal at the subtracter 108. Using the speech signal vector Y from the subtracter 108 as the target vector, the subtracter 113 computes the error vector $E_j$ with respect to the synthetic speech vector from the weighting synthesizing filter 112. A square error computing circuit 114 calculates the square sum $\|E_j\|$ of errors. A minimum distortion searching circuit 115 detects the minimum value of the $\|E_j\|$ and an index j that provides the minimum value. The index j is supplied to the adaptive code book 110 and a multiplexer 142.

Specifically, the error vector $E_j$ is expressed by the following equation (4). By partially differentiating the error vector $\|E_j\|$ with respect to β and equalizing the resulting expression to zero, the minimum value of $\|E_j\|$ in optimizing β is expressed by equation (5) where β is a gain assigned by a multiplier 111.

$$E_j=Y-\beta HX_j \tag{4}$$

$$\|E_j\|_{min}=\|Y\|-\frac{(Y,HX)^2}{\|HX_j\|} \tag{5}$$

where $\|X\|$ is a square norm, (X, Y) an inner product, and H the impulse response matrix of a weighting synthesizing filter (whose transfer function is $H_w(z)$) expressed by equation (6):

$$H=\begin{bmatrix} h(1) & & \\ h(2) & h(1) & \\ h(3) & h(2) & h(1) & 0 \\ \cdot & & & \cdot \\ \cdot & & & \cdot \\ \cdot & & & \cdot \\ h(k) & h(k-1) & \dots & h(1) \end{bmatrix} \tag{6}$$

As seen from equation (5), the searching of the adaptive code book 110 for the driving signal vector is done by computing the second term on the right-hand side of equation (5) for every code-word $X_j$, and detecting an index for the maximum code-word.

In this way, after the optimum driving signal vector $X_{opt}$ has been retrieved from the adaptive code book 110, the output of the weighting synthesizing filter 112 corresponding to $X_{opt}$ is subtracted from the target vector Y at the subtracter 113. The output of the subtracter 113 becomes the target vector in searching the noise code book 120 for the noise vector. The searching of the noise code book 120 for the noise vector can be done in the same way as the searching of the adaptive code book 110 for the driving signal vector. If the code vector retrieved from the noise code book 120 is $N_{opt}$, the driving signal vector of the synthesizing filter will be expressed as:

$$X=\beta_A\cdot X_{opt}+g\cdot N_{opt}$$

where β and g are gains to be assigned by the multipliers 111 and 121 to the driving signal vector and the noise vector retrieved from the adaptive code book 110 and noise code book 120.

The construction of constantly correcting the driving signal vector in the noise code book 120 by learning, which is the subject-matter of the invention, will be explained.

In FIG. 7, a training vector creating section 162 and a learning section 163 are provided for learning.

When the searching of the noise code book 120 for the driving vector ends with a subframe, the optimum driving signal vector $N_{opt}$ is supplied from the noise code book 120. The training vector creating section 162 sets this driving signal vector to training vector $V_r$. The learning section 163, using the training vector from the training vector creating section 162, constantly corrects the driving signal vectors stored in the noise code book 120 by learning. The correction is made in parallel with the encoding action.

Figure 8:
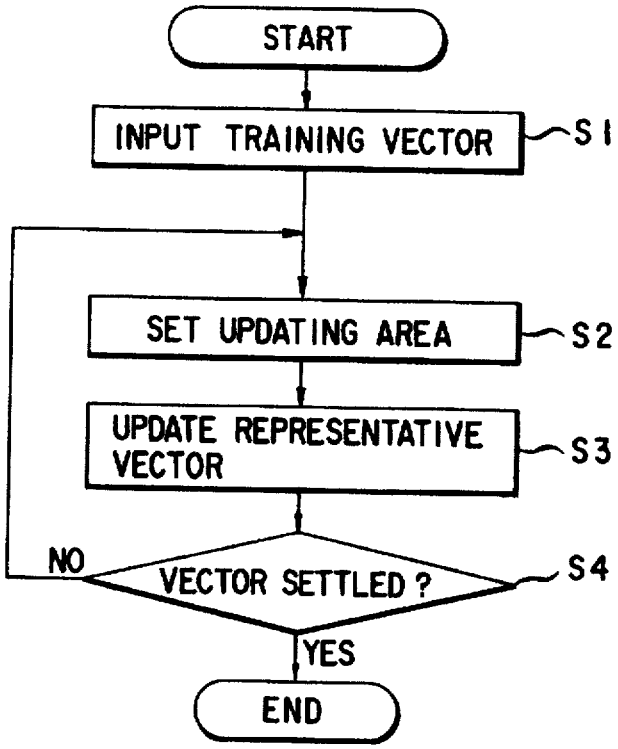
FIG. 8 is a flowchart for explaining the procedure of learning driving signal vectors in the fifth embodiment.

The learning procedure is shown in FIG. 8.

First, the training vector $V_r$ from the training vector creating section 162 is entered (S1).

Next, of a plurality of driving signal vectors stored in the noise code book 120, the vector to be corrected or updated is set (update area setting S2).

A method to set the update area is such that representative vectors existing within a constant Euclidean distance from training vector $V_r$ are set in the update area. Here, the driving signal vectors in the noise code book are referred to as representative vectors.

It is assumed that the size of the update area becomes smaller as time passes.

If the update area at time i is NE(i), the NE(i) has the nature represented by the following expressions:

$$NE(i+1)NE(i)$$

$$\lim_{i<\infty} NE(i)=\Phi$$

Then, the representative vectors in the update area are updated (corrected), using training vector $V_r$. The representative vectors $V_j(i)$ contained in the update area at time i are updated according to the following equation:

$$V_j(i+1)=(1-\alpha(i))V_j(i)+\alpha(i)V_r$$

where α(i) is a variable that controls the amount of correction and has the nature according to the following expressions:

$$0\leqq\alpha(i)\leqq 1$$

$$\alpha(i+1)<\alpha(i)$$

It is judged whether or not the updating has converged (S4). The updating is continued until the convergence is complete. The judgment of convergence is made based on whether the following equations are fulfilled or not. When they are met, it is judged that the convergence has been completed.

$$\alpha(i)=0 \text{ or } NE(i)=\Phi$$

This learning method is one of neural network learning methods known as Kohonen's algorithm. Since the Kohonen's algorithm has been described in T. Kohonen, "Self-Organization and Associative Memory," Springer-Verlag, 1984 (literature 3), its detailed explanation will be omitted.

The learning method is not limited to what has been explained here, but other learning methods may be used.

Through the learning noted above, the driving vector in the noise code book 120 comes to have a nature statistically resembling that of the driving signal vector used as the training vector. As noted earlier, the driving signal of the synthesizing filter is produced so that the error between the input speech signal to be encoded and the synthetic signal may be minimal. Thus, by learning with the driving signal and correcting the driving signal vectors in the noise code book 120, the noise code book suited for producing a synthetic speech less different from the input speech or with less distortion.

Since learning is done in parallel with the speech encoding process, the nature of the driving signal vector in the noise code book 120 changes as the nature of the input speech signal changes. As a result, even when the number of bits allocated to the driving signal is small because of an encoding rate as low as less than 8 kbps, it is possible to synthesize a high-quality speech.

In a conventional CELP system, the speech signal is reproduced, using the same noise code book, regardless of the nature of the input speech signal changing.

In contrast, with the present embodiment, by the above-described learning, the driving signal vectors in the noise code book change so that errors in the synthetic signal with respect to the input speech signal may become smaller. This allows the creation of a higher-quality synthetic speech, provided that the number of bits allocated to the driving signal is the same.

The encoded parameter obtained from the above-described processes are multiplexed at the multiplexer 142 and the resulting signal is supplied as the encoded output from the output terminal 143 to the transmission line. Specifically, the multiplexer 142 multiplexes the following: the code obtained from the encoding circuit 103 that encodes the information on the LPC prediction coefficient created by the LPC analyzing circuit 102; the index code in the adaptive code book 110 obtained at the minimum distortion searching circuit 115; the code obtained from the gain encoding circuit 140 that encodes the information on a gain to be multiplied at the multiplier 111; the index code in the noise code book 120 obtained at the minimum distortion searching circuit 125; and the code obtained from the gain encoding circuit 141 that encodes the information on a gain to be multiplied at the multiplier 121.

The construction of a speech decoding apparatus corresponding to the FIG. 7 speech encoding apparatus will be explained, referring to FIG. 9.

Figure 9:
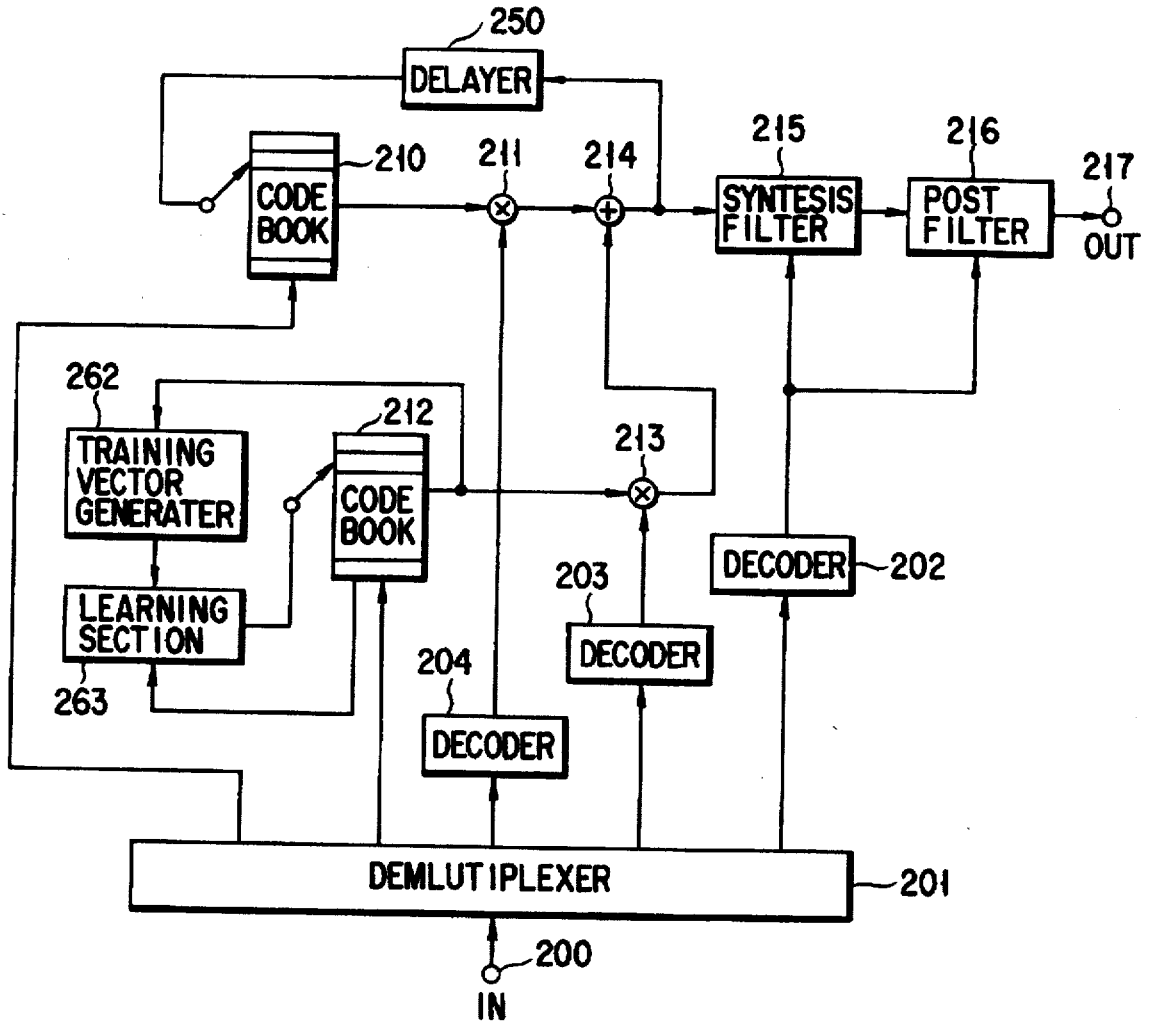
FIG. 9 is a block diagram of a speech decoding apparatus of the fifth embodiment.

In FIG. 9, the input encoded parameter is broken down by the demultiplexer 201 into respective parameters, which are then decoded by decoders 202, 203, and 204. A driving signal is produced based on the index and gain in the decoded adaptive code book and the index and gain in the decoded noise code book. By filtering the driving signal at the synthesizing filter 215, a synthetic speech signal is produced. The synthetic speech signal has its spectrum shaped at a post filter 216 to suppress auditory distortion, and then the resulting signal is supplied from the output terminal 217.

In FIG. 9, to learn the driving signal vectors in the noise code book 212, a training vector creating section 262 and a learning section 263 are provided. These have the same functions as those of the training vector creating section 162 and learning section 163 of FIG. 7, and operate in the same manner, so that their detailed explanation will be omitted.

As can be seen from the present embodiment, with the invention, a signal used for training is designed to be obtained from both encoding and decoding processes. As a result, it is not necessary to transfer any supplementary information for learning the code book, thereby preventing the bit rate from increasing.

Embodiment 6

Figure 10:
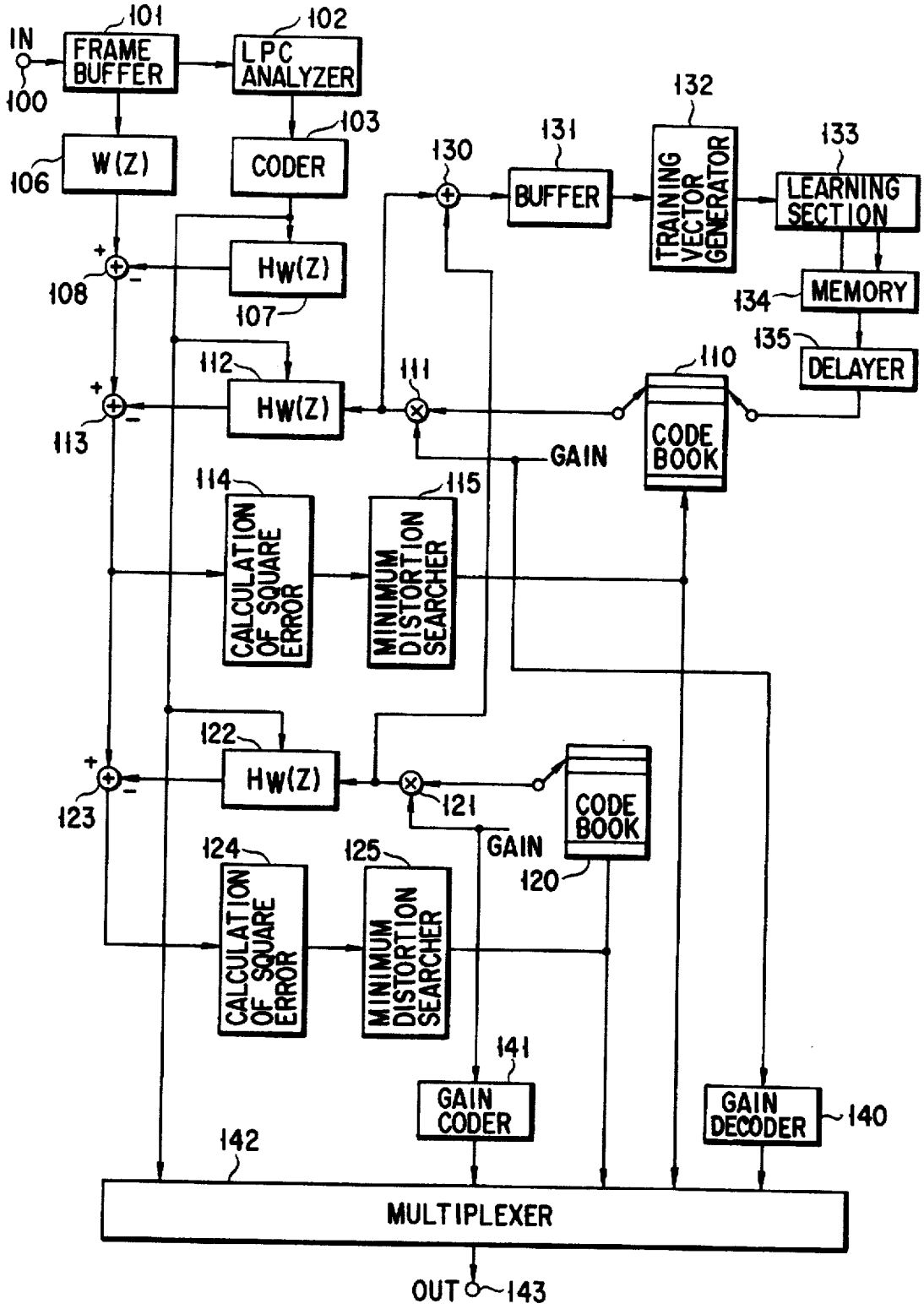
FIG. 10 is a block diagram of a learning-type speech encoding apparatus according to a sixth embodiment of the present invention.

FIG. 10 is a block diagram of a learning-type speech encoding apparatus according to a sixth embodiment of the present invention.

While in the fifth embodiment, the updating is done by learning the contents of the noise code book, the contents of the adaptive code book may be updated. This embodiment is an example of learning the adaptive code book. In FIG. 10, a buffer 131, a training vector creating section 132, a learning section 133, a memory 134, and a delay circuit are provided for learning.

Figure 11:
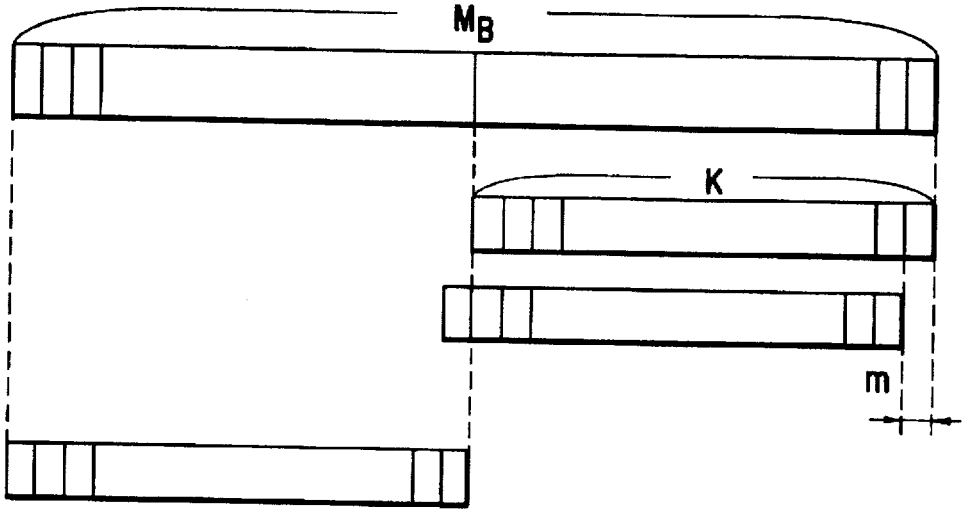
FIG. 11 is a diagram for explaining how to create a training vector in the sixth embodiment.

When the searching of the adaptive code book 110 for the driving signal vector and the searching of the noise code book 120 for the vector have ended with a subframe, another driving signal vector of the synthesizing filter is supplied from the adder 130. The buffer 131 adds the new driving signal vector to the driving signal vector of the past subframe, and stores the result. Specifically, the buffer 131 is composed of a shift register that can accumulate $M_B$ samples of data as shown in FIG. 11. It accumulates the information on the total of $M_B$ samples of driving signal vectors including the driving signal vector newly supplied from the adder 130.

The information on the driving signal vector in the buffer 131 is read into the training vector creating section 132. The training vector creating section 132 segments the information on the driving signal vector in the buffer 131 in units of a vector dimension of K, while shifting in sequence for ever m samples, and supplies the resulting unit as the training vector to the learning section 133. Although in FIG. 11, m is m=1, m may be other numbers, such as m=2 or 3. In FIG. 11, $M_B$ is $M_B$=2K. For example, when m=1 and $M_B$=2K, K-1 vectors will be produced as training vectors.

The learning section 133, using the training vector from the training vector creating section 132, constantly corrects the driving signal vectors stored in the adaptive code book 110 by learning. This correction is made in parallel with the encoding action.

Figure 12:
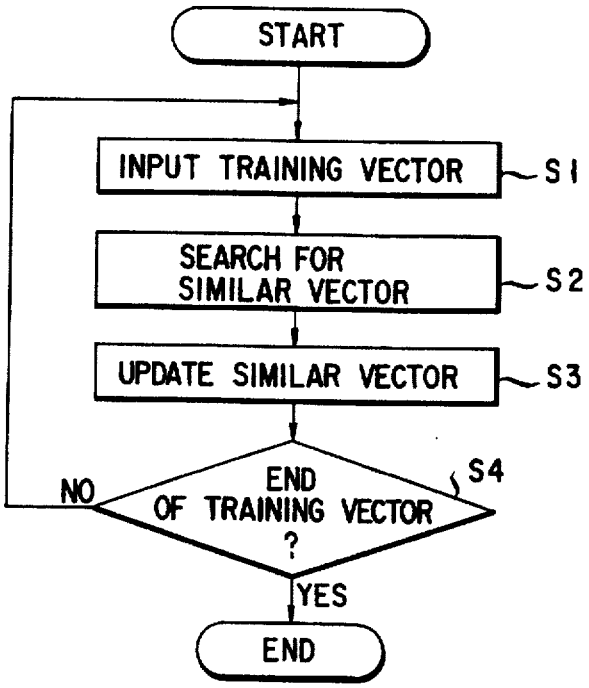
FIG. 12 is a flowchart for the procedure of learning driving signal vectors in the sixth embodiment.

The learning procedure is shown in FIG. 12.

Figure 13:
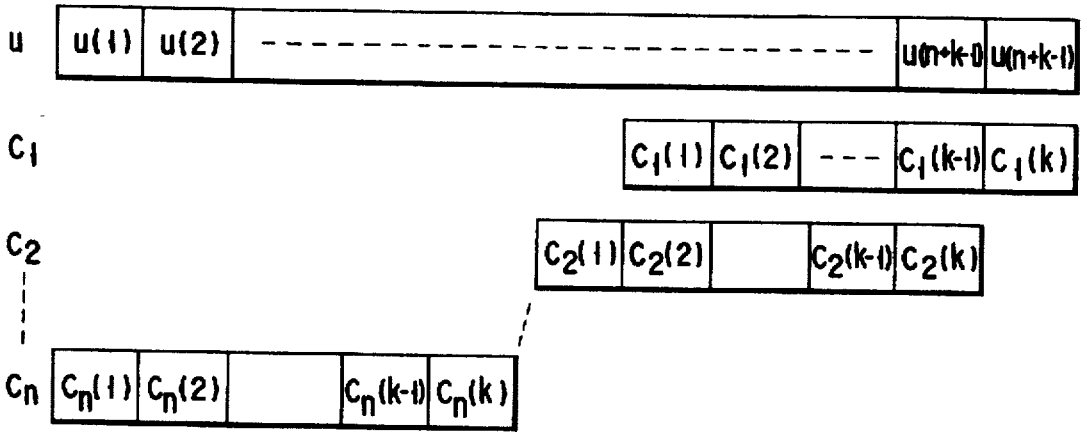
FIG. 13 is a diagram showing how driving signal vectors are stored in the memory in the sixth embodiment.

The training vector is supplied from the training vector creating section 132 (S1). Then, the memory 134, which stores a plurality of driving signal vectors, is searched for a vector that resembles the input training vector most (S2). It is possible to use the reciprocal of the Euclidean distance as the degree of similarity. As shown in FIG. 13, the driving signal vector in the memory 134 is stored in the shift register in the form of an N-long signal train. The driving signal vector is produced by segmenting the signal train in units of a vector dimension of K, and shifting the data from the rightmost position of the shift register one sample at a time. If the total number of driving signal vectors in the adaptive code book is L, the relationship expressed by the following equation holds:

$$N=L+K^{-1}.$$

Then, using training vector $V_r$, the similar vector $C_j$ obtained at step S2 is updated according to the following equation:

$$C_j=(1-\alpha)C_j+\alpha V_r \text{ provided } 0<\alpha<1$$

where $\alpha$ is a coefficient that controls the weighted average of $C_j$ and $V_r$ and takes a predetermined value or a value that changes according to the degree of similarity mentioned earlier. The updating of the driving signal vector in the memory 134 is done following the above equation. Actually, part of the signal train in the shift register from which the driving signal vector $C_j$ has been segmented is updated. By repeating the processes described above until step S4 judges that training vectors have run out, the learning of the driving signal vectors in the memory 134 is done. After the learning is complete, the signal train stored in the shift register of the memory 134 is segmented in units of a driving signal vector dimension of K, being shifted one sample at a time at the delay circuit 135, and the resulting unit is stored in the adaptive code book 110. This completes a series of learning. The adaptive code book is not necessarily required. Instead, the memory 134 may be used as a virtual adaptive code book.

With such learning, the driving signal vectors in the adaptive code book 110 come to have a nature statistically resembling the driving signal vector used as the training vector. Because the learning is done in parallel with the encoding of speech, the nature of the driving signal vectors in the adaptive code book 110 changes as the nature of the input speech signal changes. As a result, even if the number of bits allocated to the encoding of the driving signal is small because of an encoding rate as low as less than 8 kbps, it is possible to synthesize a high-quality speech.

The conventional CELP system has the problem that when the nature of the input speech signal has changed abruptly from the unvoiced sound to the voiced sound, the contents of the adaptive code book contain the driving signal vectors in the unvoiced section only, which prevents the periodic driving signals needed for synthesizing a voiced sound from being produced swiftly, thus creating a delay in following the changing speed of the input speech signal. As a result, there arises an articulation problem. With the present invention, however, since the driving signal vectors in the past voiced sound section are retained in the adaptive code book through the aforementioned learning action, even if the input speech signal has suddenly changed from the unvoiced sound to the voiced sound, a voiced sound can be synthesized using the retained driving signal vectors, which makes it possible to obtain an articulate synthetic speech.

As seen from FIG. 13, the driving signal vectors overlap each other, so that it is possible to reduce the amount of calculations required for searching the adaptive code book for the optimum driving signal vector. As has been described in the aforesaid literature 2, the conventional adaptive code book is also constructed so that each vector may overlap one another, which enables an efficient search for the optimum driving signal vector. With the present invention, however, in addition to the effective search by the prior art, the adaptive code book is constructed so that the overlapping structure may be maintained with the help of the learning action even if the contents of the adaptive code book are undated at random.

The encoded parameters obtained from the above processes are multiplexed at the multiplexer 142, and the resulting signal is supplied as the encoded output from the output terminal 143 to the transmission line.

Figure 14:
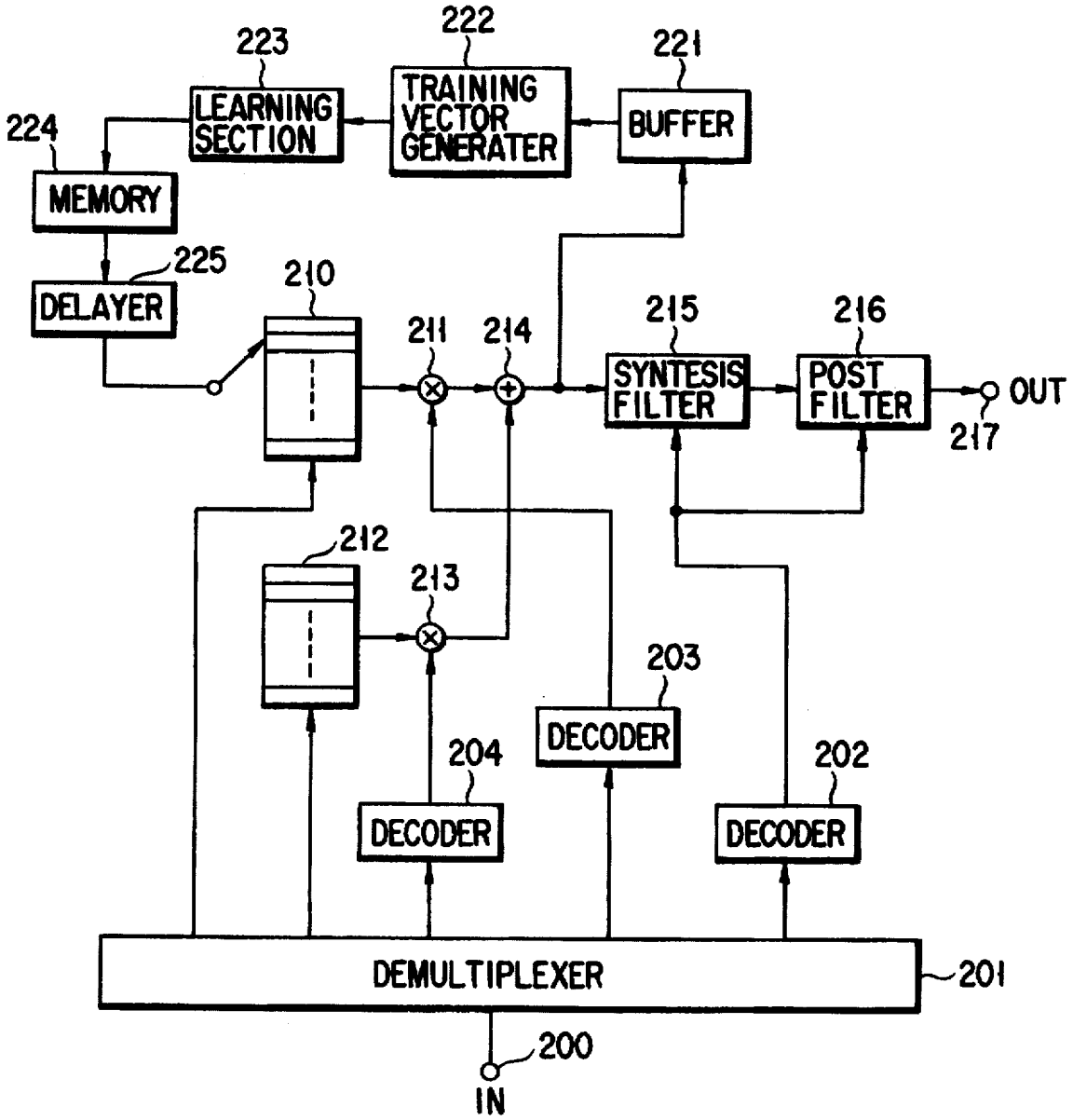
FIG. 14 is a block diagram of a speech decoding apparatus of the sixth embodiment.

The construction of a speech decoding apparatus corresponding to the FIG. 10 speech encoding apparatus is shown in FIG. 14.

First Effect

As described so far, with the present invention, driving signal vectors having neither an adaptive code book nor a noise code book come to have a nature statically resembling the driving signal vector used as the training vector. On the other hand, the driving signal of the synthesizing filter is produced by searching the adaptive code book and noise code book for the optimum driving signal vector, referring to the input speech signal to be encoded, or searching for the driving signal vector that minimizes the error between the input speech signal and the synthetic speech signal created by the synthesizing filter.

Therefore, by constantly correcting the driving signal vectors in the adaptive code book and noise code book through learning on the basis of the optimum driving signal vector, it is possible to create an adaptive code book and noise code book suitable for producing a synthetic speech whose distortion with respect to the input speech signal is smaller than the prior art. Since the learning is done in parallel with the encoding action, the nature of the adaptive code book and noise code book changes as the nature of the input speech signal changes.

As a result, with the present invention, a high-quality speech can be synthesized at a bit rate as low as less than 8 kbps (e.g. 4 kbps) at which in the conventional system without the learning function mentioned above, it was difficult to ensure an acceptable quality in practical use because of restrictions on the number of bits allocated to the driving signal. The driving signal vector is designed to allow the training signal for learning to be obtained from both the encoding and the decoding processes, which makes it unnecessary to transfer any supplementary information for the learning.

The difference between the fifth embodiment relating FIG. 7 and the following three embodiments resides in the element which has a learning function. That is, in the fifth embodiment, the noise code book has the function contrary to in the three embodiments. In the following embodiments, the quantizing elements (i.e. CODER 103, CODE BOOK 120, GAIN DECODER 140 and GAIN CODER 141 shows in FIG. 7) have the learning function.

Embodiment 7

Figure 15:
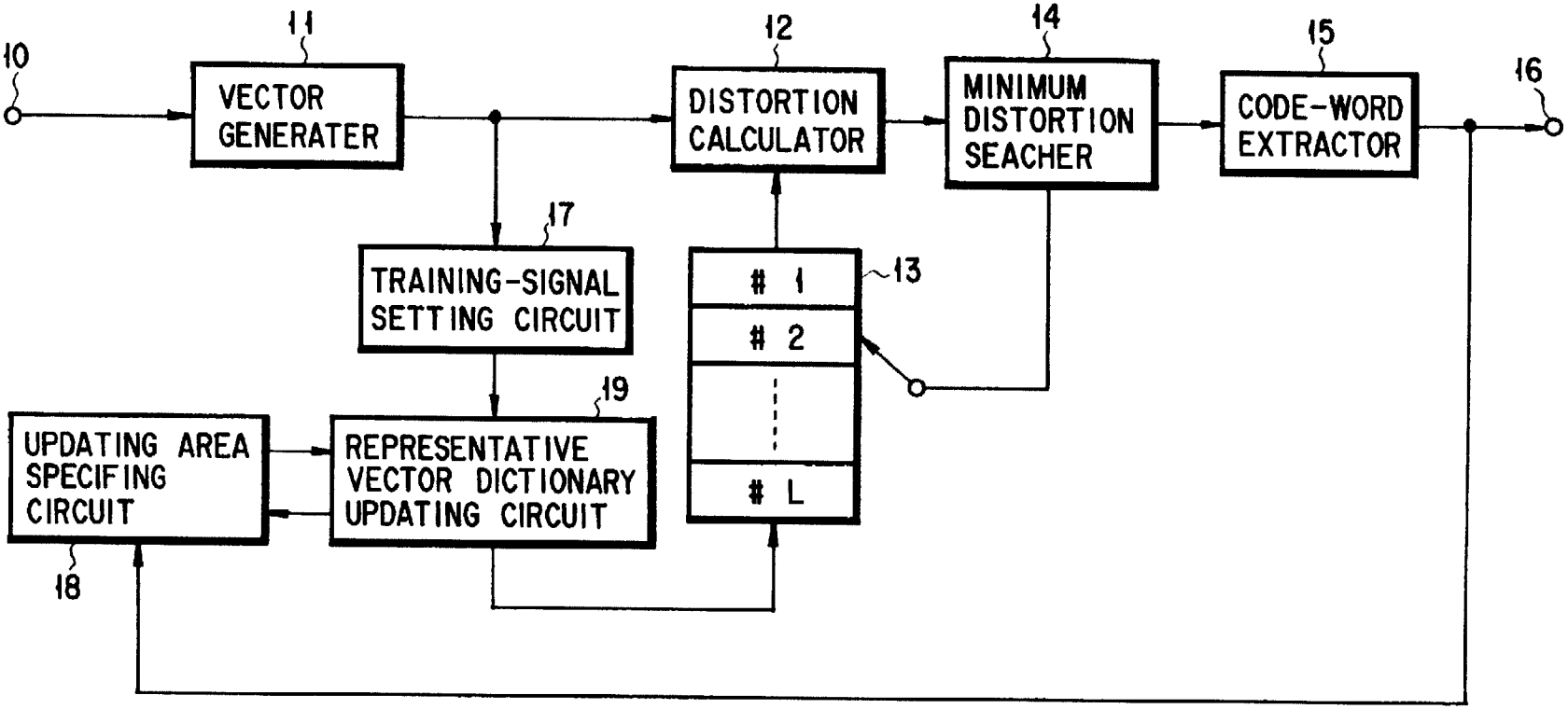
FIG. 15 is a block diagram showing the schematic construction of an encoding section of a seventh embodiment according to the present invention.

FIG. 15 shows the schematic construction of an encoding section of a seventh embodiment according to this invention. In this embodiment, the encoding section includes a vector generator 11, distortion calculator 12, representative vector dictionary 13, minimum distortion searcher 14, code-word extractor 15, training-signal setting circuit 17, updating area specifying circuit 18 and representative vector dictionary updating circuit 19.

When an input signal is sequentially input to the vector generator 11 via an input terminal 10 and K input signals are obtained, a K-dimensional vector $x=\{x_k;\ k=1, - - - , K\}$ (it is a scalar when K=1) is constructed and supplied to the distortion calculator 12 and training-signal setting circuit 17.

The distortion calculator 12 derives distortions $d_l$ between the input vector x obtained from the vector generator 11 and representative vectors $y_l$ of the representative vector dictionary 13. The representative vector dictionary 13 has representative vectors $y_l$ of #1 to #L and each of the representative vectors $y_l$ has K elements. The square distortion shown by the following equation (15) is used as the distortion measure.

$$d_l = \sum_{k=1}^{k} (x_k - y_{lk})^2 \tag{15}$$

After the distortions $d_l$ are derived by the distortion calculator 12 for all of the representative vectors $y_l$ of #1 to #L of the representative vector dictionary 13, a distortion $d_l^*$ which is the smallest one of the distortions $d_l$ derived by the distortion calculator 12 is searched for by the minimum distortion searcher 14 and a representative vector $y_l^*$ corresponding to the minimum distortion is output from the representative vector dictionary 13 to the code-word extractor 15.

The code-word extractor 15 extracts a code-word $_l^*$ corresponding to the received representative vector $y_l^*$, outputs the same from an output terminal 16 and supplies the same to the updating area specifying circuit 18. In this case, the output code-word $_l^*$ is expressed by the following equation (16).

$$l^* = \arg\left[\min_{l \in L} dl\right] \tag{16}$$

where arg[] is a function for deriving a code-word.

When the input vector x is supplied from the vector generator 11 to the training-signal setting circuit 17, the input vector x is substituted into the training signal $\tau=\{_k;\ k=1, - - - , K\}$ in the training-signal setting circuit 17 so as to derive the following equation (17).

$$\tau = x \tag{17}$$

Then, the training signal is supplied to the representative vector dictionary updating circuit 19. In the updating area specifying circuit 18, an updating area is specified by use of the output code-word $_l^*$ supplied from the code-word extractor 15.

In this state, portions of the representative vector dictionary for the updating area specified by the updating area specifying circuit 18 are updated by the representative vector dictionary updating circuit 19 by use of the training signal z supplied from the training-signal setting circuit 17.

Then, if the updating completion condition is satisfied, the representative vector dictionary updating process is completed and a process for the next input signal is started, and if the updating completion condition is not satisfied, the representative vector dictionary updating process is continuously effected.

Figure 16:
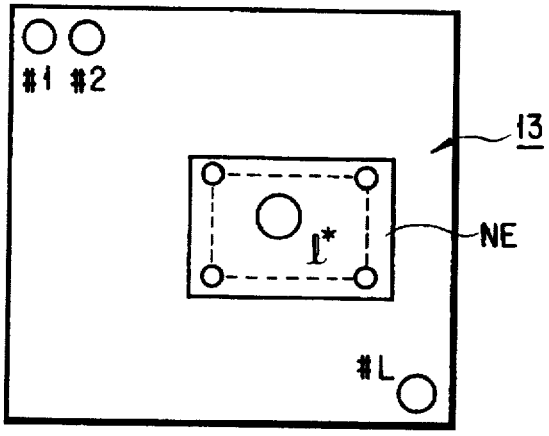
FIG. 16 is a two-dimensional plane view for illustrating an updating area specifying method in the seventh embodiment.

In the process continuing case, a representative vector $y_l$ contained in an area NE near a representative vector $y_l^*$ having the output code-word $_l^*$ as its own code-word when the representative vectors $y_l$ of #1 to #L in the representative vector dictionary 13 are arranged on a two-dimensional plane as shown in FIG. 16, for example, is specified as the updating area for the representative vector $y_l^*$ in the above updating area specifying process.

Further, as a method for specifying the updating area, a method of considering an ultraspherical space having a representative vector $y_l^*$ having the output code-word $_l^*$ as its own code-word at its center in a K-dimensional vector space and setting another representative vector $y_l$ contained in the ultraspherical space as an updating area or a method of setting a preset number of representative vectors $y_l$ lying at a short distance from a representative vector $y_l^*$ having the output code-word $_l^*$ as its own code-word in a K-dimensional vector space as the updating area may be used.

If the updating area specifying function at time i is NE(i), NE(i) has properties indicated by the following expressions (18).

$$NE(i+1)NE(i)$$

$$\lim_{\to\infty} NE(i)=\phi(i\geqq 1) \quad (18)$$

The updating process for the representative vector $y_l(i)$ contained in the updating area at time i is effected to derive $y_l(i+1)$ indicated by the following equation (19) and obtained as the result of the updating process when the training signal used in the updating process is $\tau$.

$$y_l(i+1)=(1-\alpha(i))y_l(i)+\alpha(i)\tau \text{ for all } l\ NE(i) \quad (19)$$

$\alpha(i)$ is a function of providing the ratio of the interior division point between $y_l(i)$ and $\tau$ at time i and has the properties indicated by the following expressions (20).

$$0\leqq\alpha(i)\leqq 1$$

$$\alpha(i+1)<\alpha(i)(i\geqq 1)\text{tm} \quad (20)$$

The above representative vector dictionary updating process is completed when one of two conditions indicated by the following equations (21) is satisfied.

$$\alpha(i)=0$$

$$NE(i)=\phi \quad (21)$$

If the updating process is effected as described above, the contents of the representative vector dictionary 13 can be sequentially updated in response to an input signal. Therefore, even when the bias of the statistical distribution of an input signal train varies with time as in the case of a speech signal spectrum, the contents of the representative vector dictionary 13 can be updated according to the variation so that an excellent quantization performance causing less of a quantization error can be obtained.

Embodiment 8

Next, an eighth embodiment of this invention is explained with reference to the schematic diagrams of an encoding section shown in FIG. 17 and a decoding section shown in FIG. 18.

Figure 17:
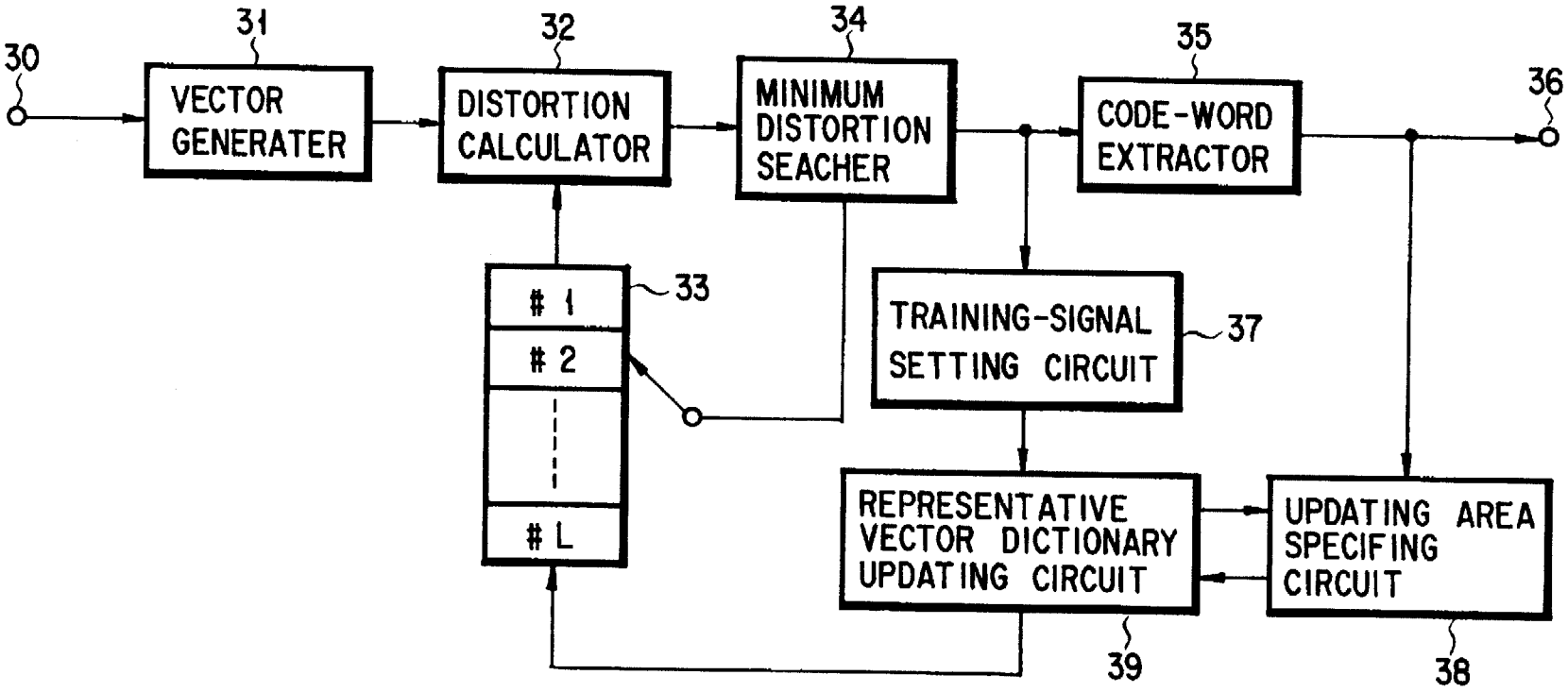
FIG. 17 is a block diagram showing the schematic construction of an encoding section of a eighth embodiment according to the present invention.

In this embodiment, the encoding section shown in FIG. 17 includes an input terminal 30, vector generator 31, distortion calculator 32, representative vector dictionary 33, minimum distortion searcher 34, code-word extractor 35, output terminal 36, training-signal setting circuit 37, updating area specifying circuit 38 and representative vector dictionary updating circuit 39.

Figure 18:
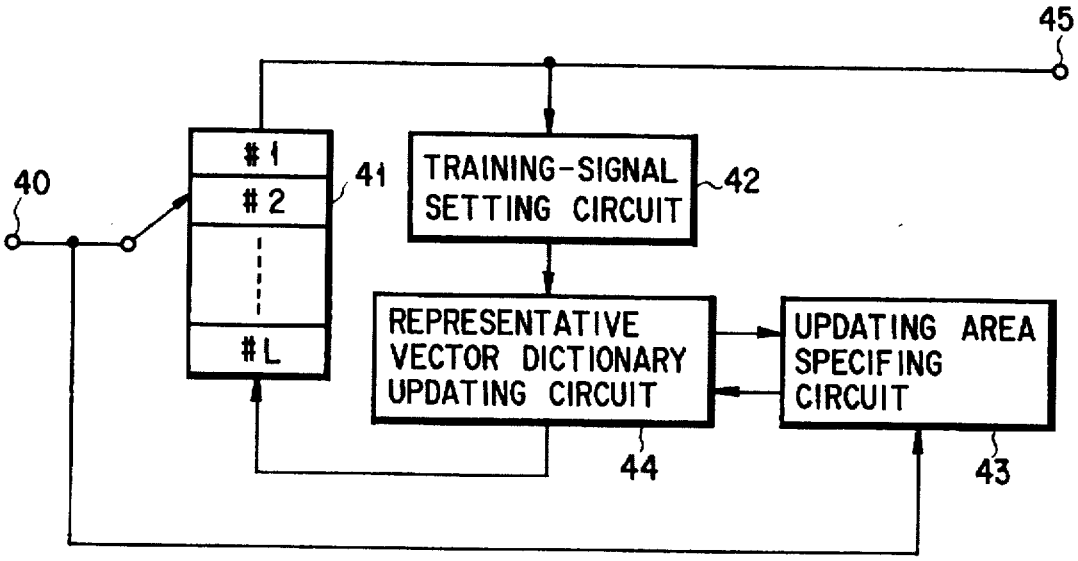
FIG. 18 is a block diagram showing the schematic construction of a decoding section of the eight embodiment according to the present invention.

The decoding section shown in FIG. 18 includes an input terminal 40, representative vector dictionary 41, training-signal setting circuit 42, updating area specifying circuit 43, representative vector dictionary updating circuit 44 and output terminal 45. The circuits which are the same as those shown in FIG. 15 have the same function of the latter circuits and therefore the explanation thereof is omitted.

The encoding section shown in FIG. 17 is different from the seventh embodiment shown in FIG. 15 in that signals used for determining the training signal $\tau$ are different from each other. That is, in the seventh embodiment, the input vector signal x is used for determining the training signal $\tau$, but in the eighth embodiment, a minimum distortion representative vector $y_l^*$ output from the minimum distortion searcher 34 is used. Therefore, the training signal which is the same as that used in the encoding section can be used in the decoding section.

In this case, the function of the training signal setting circuit 37 can be expressed by the following equation (22).

$$\tau=y_l^*\text{tm} \quad (22)$$

With the above function, the contents of the representative vector dictionary 33 can be updated in response to the input signal as in the case of the seventh embodiment.

In the decoding section shown in FIG. 18, a code-word $_l^*$ corresponding to the minimum distortion representative vector $y_l^*$ is supplied to the input terminal 40 and the minimum distortion representative vector $y_l^*$ is selected from the representative vectors $y_l$ of #1 to #L of the representative vector dictionary 41 by use of the code-word $y_l^*$. Then, the minimum distortion representative vector $y_l^*$ is output from the output terminal 45 as an output signal and supplied to the training-signal setting circuit 42. The training-signal setting circuit 42 sets the minimum distortion representative vector $y_l^*$ to a training signal and supplies the same to the representative vector dictionary updating circuit 44. Like the updating area specifying circuit 18, in the updating area specifying circuit 43, the updating area is specified by use of an input code-word $_l^*$ supplied via the input terminal 40 and then the area is supplied to the representative vector dictionary updating circuit 44.

Thus, like the representative vector dictionary updating circuit 19, the representative vector dictionary updating circuit 44 updates the representative vector dictionary until the completion condition is satisfied.

Embodiment 9

Next, a ninth embodiment of this invention is explained with reference to FIGS. 19 and 20.

Figure 19:
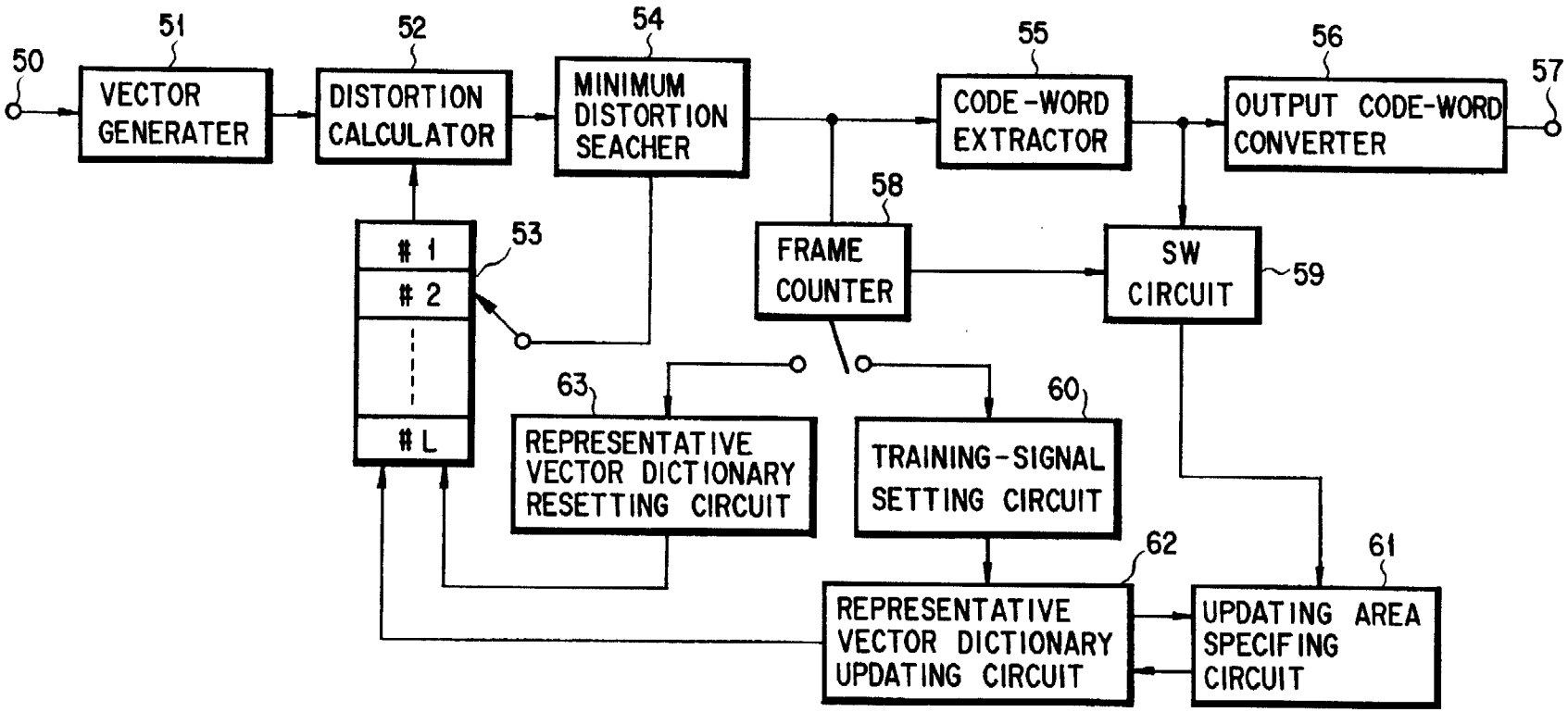
FIG. 19 is a block diagram showing the schematic construction of an encoding section of a ninth embodiment according to the present invention.

In this embodiment, an encoding section shown in FIG. 19 includes an input terminal 50, vector generator 51, distortion calculator 52, representative vector dictionary 53, minimum distortion searcher 54, code-word extractor 55, output code-word converter 56, output terminal 57, frame counter 58, switching circuit 59, training-signal setting circuit 60, updating area specifying circuit 61, representative vector dictionary updating circuit 62 and representative vector dictionary resetting circuit 63.

Figure 20:
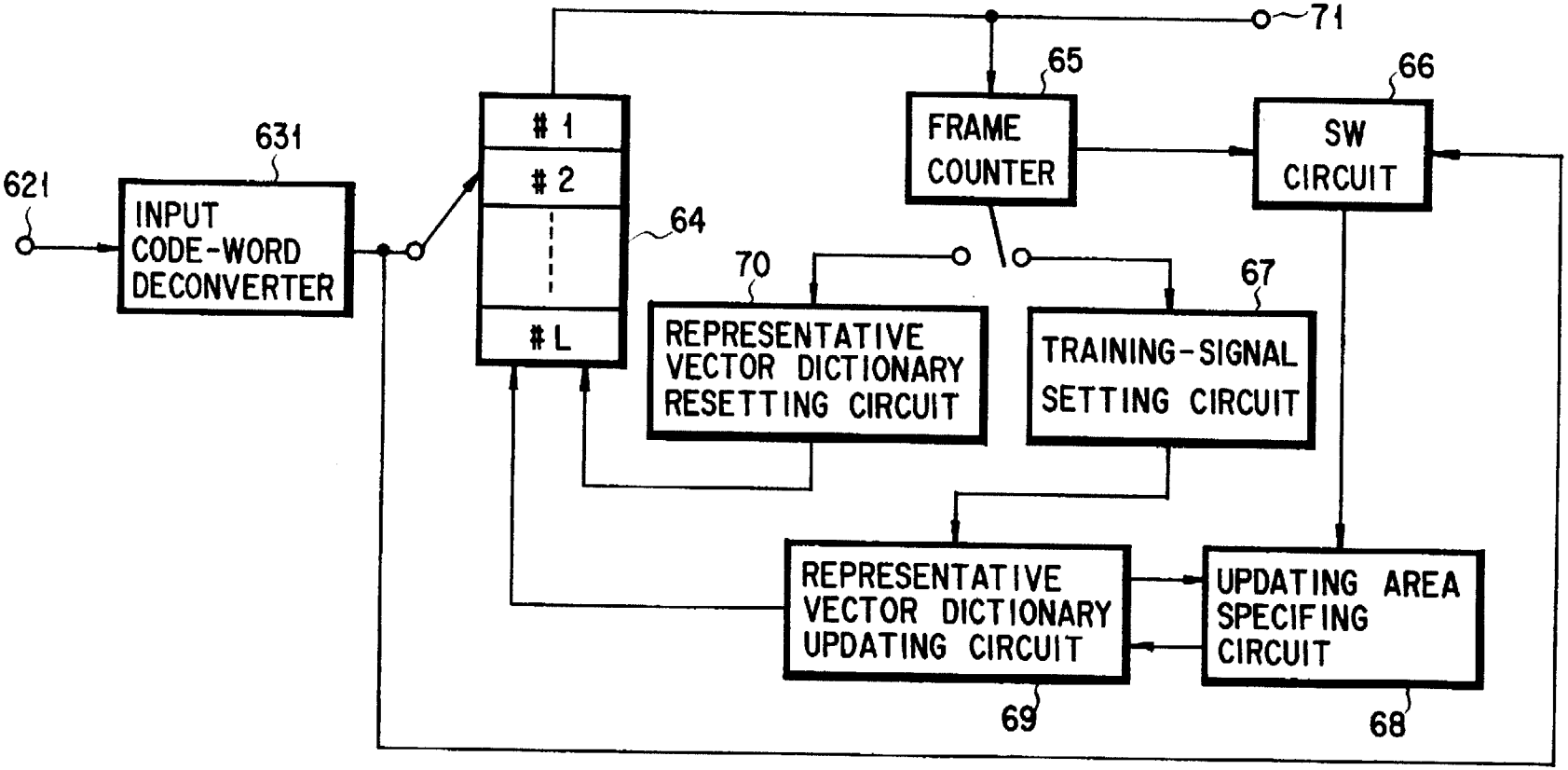
FIG. 20 is a block diagram showing the schematic construction of a decoding section of the ninth embodiment according to the present invention.

A decoding section shown in FIG. 20 includes an input terminal 621, input code-word de-converter 631, representative vector dictionary 64, frame counter 65, switching circuit 66, training-signal setting circuit 67, updating area specifying circuit 68, representative vector dictionary updating circuit 69 and representative vector dictionary resetting circuit 70.

The difference between the encoding circuit of this embodiment and the encoding circuit of the eighth embodiment is as follows. That is, the output code-word converter 56 for converting an output code-word output from the code-word extractor 55 to another code-word is provided, the representative vector dictionary updating circuit 62 for updating the representative vector dictionary 53 and the representative vector dictionary resetting circuit 63 for resetting (e.g. initializing) the representative vector dictionary 53 are used, and the updating/initialization/continuation specifying function for specifying the operation of "updating" the representative vector dictionary 53, "initializing" the representative vector dictionary or "continuously using the representative vector dictionary 53 without changing the present state thereof" is additionally provided.

However, in this case, if the minimum distortion representative vector $y_l^*$ output from the minimum distortion searcher 54 is supplied to the code-word extractor 55, the code-word $_l^*$ of the minimum distortion representative vector $y_l^*$ is output, and the code-word $_l^*$ is supplied to the output code-word converter 56, converted by the output code-word converter 56 according to the converting function H and then output as an output code-word h* from the output terminal 57.

$$h^*=H(_l^*) \tag{23}$$

The minimum distortion representative vector $y_l^*$ output from the minimum distortion searcher 54 is supplied to the frame counter circuit 58. When supplied with the minimum distortion representative vector $y_l^*$, the frame counter circuit 58 increments the count thereof by one and generates an output indicating whether the count is an integer multiple of a preset value or not.

When the count of the frame counter circuit 58 is not an integer multiple of the preset value, a minimum distortion representative vector $y_l^*$ output from the minimum distortion searcher 54 is supplied to the training-signal setting circuit 60. Further, an ON signal is supplied to the switching circuit 59. After this, an output code-word $y_l^*$ from the code-word extractor 55 is supplied to the updating area specifying circuit 61 via the switching circuit 59 and the contents of the representative vector dictionary 53 are sequentially updated according to the input signal in the same manner as explained with reference to FIG. 15. That is, in a period in which the count of the frame counter circuit 58 is kept at a value different from the integer multiple of the preset value, the training-signal setting circuit 60, updating area specifying circuit 61 and representative vector dictionary updating circuit 62 are operated and the representative vector dictionary 53 is updated.

If it is designed to supply an OFF signal to the switching circuit 59 in a period in which the count of the frame counter circuit 58 is kept at a value different from the integer multiple of the preset value, an output code-word $_l^*$ is not supplied to the updating area specifying circuit 61 and the representative vector dictionary 53 can be continuously used without changing the present state thereof.

When the count of the frame counter circuit 58 is set to the integer multiple of the preset value, an ON signal is supplied to the representative vector dictionary resetting circuit 63 and an OFF signal is supplied to the switching circuit 59. As a result, supply of the output code-word $_l^*$ from the code-word extractor 55 to the updating area specifying circuit 61 is interrupted, and in this state, the representative vector dictionary 53 is reset to the initial state by the representative vector dictionary resetting circuit 63.

Figure 21:
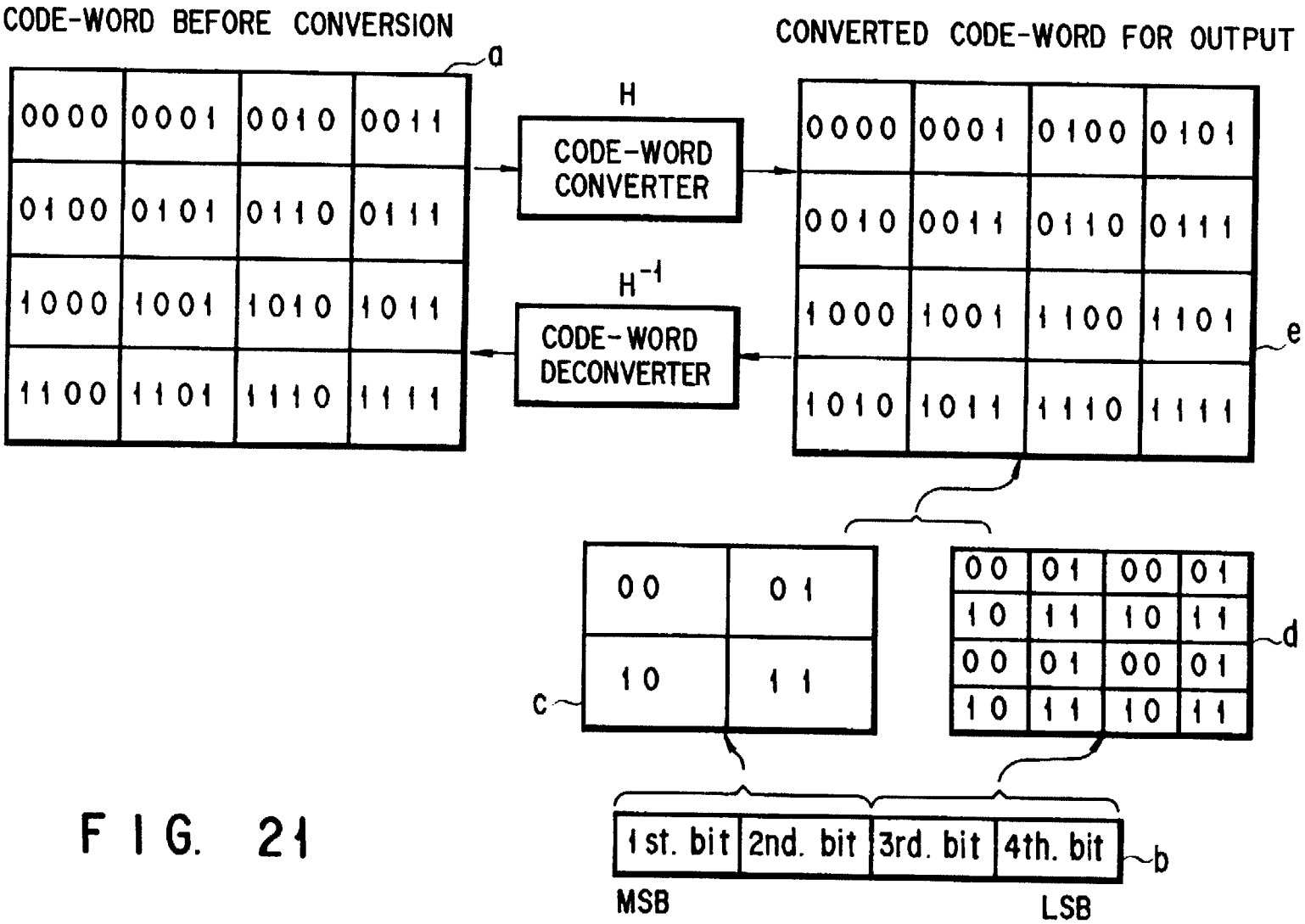
FIG. 21 is a conceptional diagram for illustrating the input code-word conversion method used in the ninth embodiment.
Figure 22:
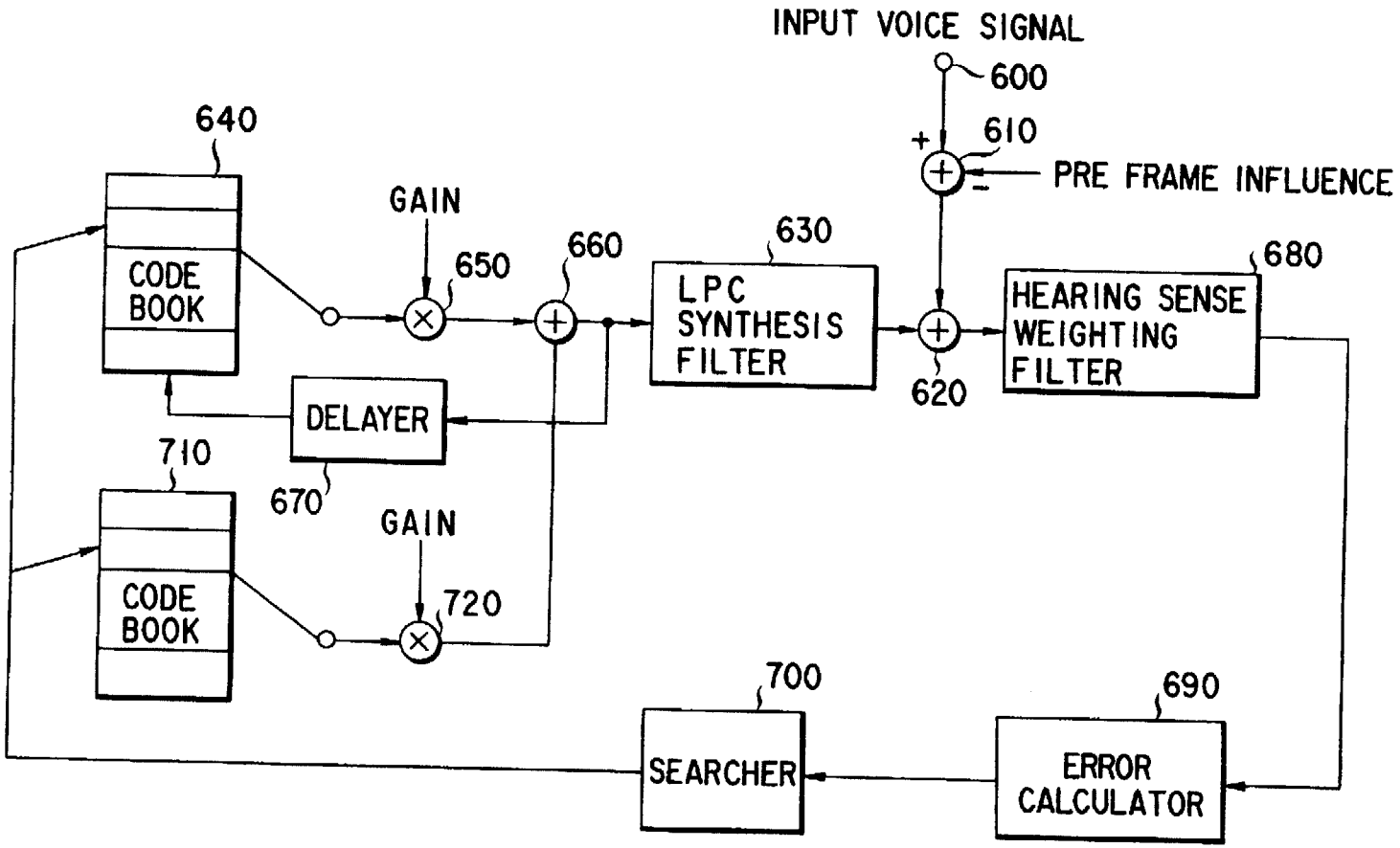
FIG. 22 (PRIOR ART)
FIG. 22 is a block diagram of a conventional speech encoding apparatus, centering on the search for the driving signal vector.

Next, the output code-word converter 56 is explained with reference to FIG. 21. If an output code-word before conversion has a 4-bit length, for example, it indicates the way of attaching numbers of four bits to the representative vectors of #1 to #L contained in the representative vector dictionary 53 in an order from the left upper position towards the right lower position when the representative vectors are arranged on a two-dimensional plane as shown in FIG. 21. In contrast, if an output code-word after conversion is a 4-bit code-word as indicated by b in FIG. 21, the former two bits thereof indicate each of four divided areas of a two-dimensional plane as shown by c in FIG. 21. The latter two bits of the code-word indicate each of four divided areas of each of the above areas as shown by d in FIG. 21 so as to create a converted code-word for output as shown by e in FIG. 21.

In the decoding section in the eighth embodiment, when the above input code-word h* is supplied to the input terminal 621, de-conversion of the code-word is effected by the input code-word de-converter 631 so as to derive a code-word $_l^*$.

$$_l^*=H^{-1}(h^*) \tag{24}$$

After this, a minimum distortion representative vector $y_l^*$ is selected from the representative vector dictionary 64 by use of the code-word $_l^*$ and output from the output terminal 71 as an output signal. At the same time, the minimum distortion representative vector $y_l^*$ is supplied to the frame counter circuit 65.

In this case, the frame counter circuit 65 increments the content thereof by one when supplied with the minimum distortion representative vector $y_l^*$. When the count of the frame counter circuit 65 is not equal to an integer multiple of the preset value, an ON signal is supplied to the switching circuit 66 and the minimum distortion representative vector $y_l^*$ is supplied to the training-signal setting circuit 67. Further, when supplied with an ON signal from the frame counter circuit 65, the switching circuit 66 supplies the output code-word $_l^*$ to the updating area specifying circuit 68, and as a result, the contents of the representative vector dictionary 64 are sequentially updated. That is, in a period in which the count of the frame counter circuit 65 is kept at a value different from the integer multiple of the preset value, the training-signal setting circuit 67, updating area specifying circuit 68 and representative vector dictionary updating circuit 69 are operated and the representative vector dictionary 64 is updated.

If it is designed to supply an OFF signal to the switching circuit 66 in a period in which the count of the frame counter circuit 65 is kept at a value different from the integer multiple of the preset value, an output code-word $_l^*$ is not supplied to the updating area specifying circuit 68 and the representative vector dictionary 64 can be continuously used without changing the present state thereof.

When the count of the frame counter circuit 65 is set to the integer multiple of the preset value, an ON signal is supplied to the representative vector dictionary resetting circuit 70. At this time, an OFF signal is supplied to the switching circuit 66. As a result, supply of the output code-word $_i$* to the updating area specifying circuit 68 is interrupted, and in this state, the representative vector dictionary 64 is reset to the initial state by the representative vector dictionary resetting circuit 70.

Second effect

With the construction of this invention, the representative vector dictionary can be sequentially updated. As a result, even when the bias of the statistical distribution of input signal train varies with time, it becomes possible to always maintain the state in which the contents of the representative vector dictionary can be continuously checked according to the above variation. Further, the vector quantization of high performance with less of a quantization error can be realized. In addition, it can be applied to the communication field by using a common training signal in the encoding section and decoding section. Further, by simply specifying the operation of updating the representative vector dictionary, resetting the representative vector dictionary to the initial state or continuously using the representative vector dictionary without changing the present state thereof, the representative vector dictionary can be updated or reset according to the result of the above specification. Particularly, deterioration of quantization performance due to communication error can be prevented by periodically resetting the representative vector dictionary.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A speech coding apparatus comprising:

a first code book for storing driving signal vectors;

a second code book for storing noise vectors;

a synthesizing filter for synthesizing one of the driving signal vectors stored in said first code book and one of the noise vectors stored in said second code book to produce a synthesized speech signal, the one of the driving signal vectors and the one of the noise vectors being selected by the synthesizing filter such that the synthesized speech signal resembles an input speech; and real-time learning means for changing said driving signal vectors stored in said first code book and said noise vectors stored in said second code book in accordance with a driving signal vector and a noise vector which were synthesized by said synthesizing filter, whereby the first and second code books are updated during a coding procedure.

2. A speech coding apparatus according to claim 1, wherein said real-time learning means comprises means for delaying the one of the driving signal vectors which was selected by said synthesizing filter for a given period of time and means for changing the driving signal vectors stored in said first code book based on the code vector delayed by said delaying means.

3. A speech coding apparatus according to claim 1, wherein said updating of code books means comprises means for calculating vector distances between the noise vectors stored in said second code book and said one of the noise vectors selected by said synthesizing filter and means for changing the noise vectors stored in said second code book based on the vector distances.

4. A speech coding apparatus according to claim 1, wherein said real-time learning means comprises means for generating a training vector used to produce the synthesized speech signal by said synthesizing filter and means for changing the vectors stored in said first code book and said second code book based on distances between the training vector and the vectors stored in said first code book and said second code book.

5. A learning-type speech coding apparatus comprising:

a plurality of code books for storing driving signals;

searching means for searching said plurality of code books for an optimum driving signal in accordance with an input speech;

a synthesizing filter for synthesizing a speech signal using the optimum driving signal searched for by said searching means;

delay means for reading out the driving signals from one of said plurality of code books which stores the optimum driving signal and delaying the driving signals read out from said one of said plurality of code books for a specified period of time; and real-time learning means for changing the driving signals stored in said plurality of code books which stores said optimum driving signal in accordance with the driving signals delayed by said delay means, whereby said one of said plurality of code books is updated during a coding procedure.

6. A learning-type speech coding apparatus comprising:

a plurality of code books for storing driving signals;

selecting means for analyzing an input speech signal and selecting one of said plurality of code books based on a result of analysis;

searching means for searching said one of said plurality of code books selected by said selecting means for an optimum driving signal in accordance with an input speech;

a synthesizing filter for synthesizing a speech signal using the optimum driving signal searched for by said searching means;

delay means for reading out the driving signals from said one of said plurality of code books selected by said selecting means and delaying the driving signals; and real-time learning means for changing the driving signals stored in said one of said plurality of code books which stores said optimum driving signal in accordance with the driving signals delayed by said delay means, whereby said one of said plurality of code books is updated during a coding procedure.

7. A learning-type speech coding apparatus sequentially coding frames of input speech, comprising:

a plurality of code books for storing driving signals;

searching means for searching a first code book which was used for obtaining a driving signal in a coding procedure of a preceding frame, for a first optimum driving signal in accordance with a present frame of the input speech;

searching means for searching a second code book for a second optimum driving signal in accordance with the present frame of said input speech;

means for determining whether or not a difference in a degree of optimum between the first optimum driving signal and the second optimum driving signal is larger than a threshold value;

select means for selecting a third optimum driving signal among the driving signals stored in said plurality of code books based on a result of the determination by said determining means;

a synthesizing filter for synthesizing a speech signal using the third optimum driving signal selected by said select means;

delay means for delaying the third optimum driving signal selected by said select means; and real-time learning means for changing the driving signals stored in a given code book which stores said third optimum driving signal, whereby said one of said plurality of code books is updated during a coding procedure.

8. A speech coding apparatus including an adaptive code book for storing driving signal vectors, a noise code book for storing noise signal vectors, and a synthesizing filter for synthesizing one of said driving signal vectors stored in said adaptive code book and one of said noise vectors stored in said noise code book to produce a speech signal, said speech coding apparatus comprising:

means for producing a training vector regarding an input speech on the basis of said one of said driving signal vectors used by said synthesizing filter; and real-time learning means, connected to said training vector producing means, for updating the driving signal vectors stored in said adaptive code book on the basis of said training vector during a coding procedure wherein said real-time learning means comprises means for delaying the one of the driving signal vectors which was selected by said synthesizing filter for a given period of time and means for changing the driving signal vectors stored in said first code book based on the code vector delayed by said delaying means.

9. A speech coding apparatus according to claim 8, wherein said real-time learning updating means comprises means for calculating vector distances between the noise vectors stored in said second code book and said one of the noise vectors selected by said synthesizing filter and means for changing the noise vectors stored in said second code book based on the vector distances.

10. A speech coding apparatus according to claim 8, wherein said real-time learning means comprises means for generating a training vector used to produce the synthesized speech signal by said synthesizing filter and means for changing the vectors stored in said first code book and said second code book based on distances between the training vector and the vectors stored in said first code book and said second code book.

11. A speech coding apparatus that synthesizes a speech signal by passing driving signal vectors stored in a plurality of code books through a synthesizing filter, comprising:

means for producing the driving signal vectors to be synthesized by said synthesizing filter;

means for detecting a driving signal vector from encoded data;

delay means, connected to said code book, for delaying the driving signal vector;

means for producing a training vector in accordance with the driving signal vector detected by said detecting means; and real-time learning means for updating the driving signal vectors stored in at least one of said plurality of code books on the basis of said training vector during a coding procedure.

12. A speech coding apparatus that synthesizes a speech signal by passing driving signal vectors stored in a plurality of code books through a synthesizing filter, comprising:

means for reading out the driving signal vectors to be synthesized by said synthesizing filter from said plurality of code books;

means for detecting a driving signal vector from encoded data;

means for producing a training vector from the driving signal vector detected by said detecting means;

real-time learning means for updating the driving signals stored in at least one of said plurality of code books on the basis of said training vector during a coding procedure;

vector storing means, connected to said learning means, for temporarily storing the driving signal read out by said reading means to update the driving signals; and delay means, connected to said vector storing means and said code book, for delaying the driving signal temporarily stored in said vector storing means.

13. A speech coding apparatus comprising a coding section which comprises:

a representative vector dictionary storing a plurality of representative vectors;

vector generating means for generating an input vector based on a received input signal;

minimum distortion searching means for searching distortions between the input vector generated by said vector generating means and the representative vectors stored in said representative vector dictionary for a minimum distortion;

code-word extracting means for extracting a code word having a specified meaning of that representative vector stored in said representative vector dictionary which corresponds to the minimum distortion searched for by said minimum distortion searching means;

training-signal setting means for setting a training signal indicating a correct coding procedure based on the input vector generated by said vector generating means;

updating area specifying means for specifying an updating area indicating a to-be-updated range of said representative vector dictionary based on the representative vector corresponding to a code-word extracted by said code-word extracting means; and updating means for updating a representative vector included in the updated area specified by said updating area specifying means by use of the training signal set by said training-signal setting means.

14. A speech coding apparatus comprising a coding section which comprises:

a representative vector dictionary storing a plurality of representative vectors;

vector generating means for generating an input vector based on a received input signal;

minimum distortion searching means for searching distortions between the input vector generated by said vector generating means and the representative vectors stored in said representative vector dictionary for a minimum distortion;

code-word extracting means for extracting a code-word having a specified meaning of that representative vector stored in said representative vector dictionary which corresponds to the minimum distortion searched for by said minimum distortion searching means;

training-signal setting means for setting a training signal indicating a correct coding procedure based on the representative vector of said representative vector dictionary corresponding to the minimum distortion searched for by said minimum distortion searching means;

updating area specifying means for specifying an updating area indicating a to-be-updated range of said representative vector dictionary based on the representative vector corresponding to a code-word extracted by said code-word extracting means; and updating means for updating a representative vector included in the updated area specified by said updating area specifying means by use of the training signal set by said training-signal setting means.

15. A speech coding apparatus according to claim 14, further comprising a decoding section which comprises:

a second representative vector dictionary storing a plurality of second representative vectors;

second training-signal setting means for setting a second training signal based on the second representative vector stored in said second representative vector dictionary corresponding to the code-word having a specified meaning and extracted by said code-word extracting means of said coding section;

second updating area specifying means for specifying a second updating area of said second representative vector dictionary based on the second representative vector corresponding to the code-word extracted by said code-word extracting means of said coding section; and updating means for updating a representative vector included in the second updated area specified by said second updating area specifying means by use of the second training signal set by said second training-signal setting means.

16. A speech coding apparatus comprising a coding section which comprises:

a representative vector dictionary storing a plurality of representative vectors;

vector generating means for generating an input vector based on a received input signal;

minimum distortion searching means for searching distortions between the input vector generated by said vector generating means and the representative vectors stored in said representative vector dictionary for a minimum smallest distortion;

code-word extracting means for extracting a code-word having a specified meaning of that representative vector of said representative vector dictionary which corresponds to the minimum distortion searched for by said minimum distortion searching means;

updating/initialization/continuation specifying means for selectively specifying one of an updating, an initialization and maintaining a present state of said representative vector dictionary;

training-signal setting means for setting a training signal indicating a correct coding procedure based on the representative vector stored in said representative vector dictionary corresponding to the minimum distortion searched for by said minimum distortion searching means when said updating/initialization/continuation specifying means specifies the updating of said representative vector dictionary;

updating area specifying means for specifying an updating area indicating a to-be-updated area of said representative vector dictionary based on a representative vector corresponding to the code-word extracted by said code-word extracting means when said updating/initialization/continuation specifying means specifies the updating of said representative vector dictionary;

updating means for updating the representative vector included in the updated area specified by said updating area specifying means by use of the training signal set by said training-signal setting means;

representative vector dictionary initializing means for initializing said representative vector dictionary when said updating/initialization/continuation specifying means specifies the initialization of said representative vector dictionary; and means for maintaining the present state of said representative vector dictionary when said updating/initialization/continuation specifying means specifies the maintaining present state of said representative vector dictionary.

17. A speech coding apparatus according to claim 16, further comprising a decoding section which comprises:

a second representative vector dictionary storing a plurality of second representative vectors;

second updating/initialization/continuation specifying means for selectively specifying one of a second updating, a second initialization and a second maintaining a present state of said second representative vector dictionary;

second training-signal setting means for setting a second training signal based on the second representative vector stored in said second representative vector dictionary corresponding to a code-word having a specified meaning and extracted by said code-word exacting means of said coding section when said updating/initialization/continuation specifying means specifies the second updating of said second representative vector dictionary;

second updating area specifying means for specifying an updating area indicating a to-be-updated range of said second representative vector dictionary based on a representative vector corresponding to a code-word extracted by said code-word extracting means of said coding section when said updating/initialization/continuation specifying means specifies the second updating of said second representative vector dictionary;

second updating means for updating a representative vector included in the updated area specified by said second updating area specifying means by use of the second training signal set by said second training-signal setting means;

second representative vector dictionary initializing means for initializing said second representative vector dictionary when said second updating/initialization/continuation specifying means specifies the second initialization of said second representative vector dictionary; and means for maintaining the present state of said second representative vector dictionary when said updating/initialization/continuation specifying means specifies the second maintaining a present state of said second representative vector dictionary.

* * * * *